US012605638B1

(12) United States Patent
Horwath

(10) Patent No.: US 12,605,638 B1
(45) Date of Patent: Apr. 21, 2026

(54) MODULAR ROLLER COASTER

(71) Applicant: Luke Horwath, Barrington, IL (US)

(72) Inventor: Luke Horwath, Barrington, IL (US)

( * ) Notice: Subject to any disclaimer, the term of this patent is extended or adjusted under 35 U.S.C. 154(b) by 0 days.

(21) Appl. No.: 19/316,721

(22) Filed: Sep. 2, 2025

(51) Int. Cl.

| | |
|---|---|
| ***A63G 7/00*** | (2006.01) |
| ***A63G 21/04*** | (2006.01) |
| ***A63G 21/10*** | (2006.01) |
| ***A63G 31/00*** | (2006.01) |
| ***A63G 33/00*** | (2006.01) |
| *A63G 31/16* | (2006.01) |

(52) U.S. Cl.
CPC ..... *A63G 7/00* (2013.01); *A63G 21/04* (2013.01); *A63G 21/10* (2013.01); *A63G 31/00* (2013.01); *A63G 33/00* (2013.01); *A63G 31/16* (2013.01)

(58) Field of Classification Search
CPC ..... A63G 7/00; A63G 31/00; A63G 31/16; A63G 21/04; A63G 21/10; A63G 33/00
See application file for complete search history.

(56) References Cited

U.S. PATENT DOCUMENTS

| | | | | |
|---|---|---|---|---|
| 1,455,390 | A * | 5/1923 | Davino | A63G 7/00 105/148 |
| 4,700,632 | A | 10/1987 | Schmutz | |
| 6,837,166 | B1 * | 1/2005 | Roodenburg | A63G 7/00 104/53 |
| 7,980,181 | B2 * | 7/2011 | Heaslip | A63G 21/20 104/53 |
| 8,066,576 | B2 | 11/2011 | Threlkel | |
| 8,393,275 | B2 | 3/2013 | Jacobi et al. | |
| 8,490,549 | B2 * | 7/2013 | Kitchen | A63G 21/04 104/53 |
| 8,893,623 | B2 | 11/2014 | Gordon | |
| 9,440,156 | B2 | 9/2016 | Comorre | |
| 10,391,410 | B2 * | 8/2019 | Kitchen | A63G 7/00 |
| 10,406,386 | B2 * | 9/2019 | Beutler | A62B 3/00 |
| 10,556,511 | B2 * | 2/2020 | Roodenburg | A63G 7/00 |

FOREIGN PATENT DOCUMENTS

| | | | | |
|---|---|---|---|---|
| CN | 108712924 | B | 11/2020 | |
| KR | 101803597 | B1 | 11/2017 | |
| RU | 2650058 | C1 | 4/2018 | |
| WO | WO-2015073998 | A1 * | 5/2015 | A63G 21/04 |

OTHER PUBLICATIONS

American Eagle (roller coaster). Wikipedia (Ride Experience) [online], [retrieved on Oct. 7, 2025]. Retrieved from the Internet <URL: https://en.wikipedia.org/wiki/American_Eagle_(roller_coaster).

Whizzer (roller coaster). Wikipedia (Ride Experience) [online], [retrieved on Oct. 7, 2025]. Retrieved from the Internet <URL: https://en.wikipedia.org/wiki/Whizzer_(roller_coaster).

* cited by examiner

*Primary Examiner* — Cheng Lin
(74) *Attorney, Agent, or Firm* — MARSHALL, GERSTEIN & BORUN LLP

(57) ABSTRACT

A roller coaster that includes a first tower module, a second tower module, a first track defining a first layout spanning at least a portion of the first tower module, and a second track defining a second layout spanning at least a portion of the second tower module. At least a portion of the first layout and at least a portion of the second layout have a helical shape.

24 Claims, 32 Drawing Sheets

MODULAR ROLLER COASTER

FIELD OF THE DISCLOSURE

The present disclosure relates to roller coasters configured for modular assembly and concurrent traversal of multiple train layouts, and more particularly, to roller coasters incorporating modules such as spiral lift towers and helical track layouts adapted for installation based on user-defined parameters.

BACKGROUND

Roller coasters and amusement rides typically occupy large horizontal plots of land to accommodate sprawling track layouts. Conventional roller coasters are generally designed with single-track systems, allowing only one train of cars to traverse the track at a given time. For dual-track systems, designs often feature dueling configurations where two trains of cars race each other on parallel or intersecting tracks. Furthermore, conventional roller coasters utilize lifts that usually rely on chain-based systems to carry cars to the initial height before beginning their descent. Lastly, while aesthetics, rider throughput, and engagement are key factors for amusement park attractions, conventional roller coasters primarily focus on thrill-based layouts without optimizing competitive interaction or visual uniqueness in track designs. Dueling train features, when incorporated, typically focus on the experiential aspects between two trains and do not expand into more dynamic arrangements involving greater numbers of trains interacting simultaneously.

SUMMARY

In accordance with a first aspect of the present disclosure, a roller coaster is provided that includes: a center module having a first side and a second side opposite the first side, a first tower module disposed adjacent the first side of the center module, and a second tower module disposed adjacent the second side of the center module. The roller coaster further includes a first track defining a first layout spanning at least a first portion of the first tower module and at least a first portion of the center module, a second track defining a second layout spanning at least a first portion of the second tower module and at least a second portion of the center module, a first train of coasters configured to movably traverse the first track, and a second train of coasters configured to movably traverse the second track. The first train of coasters and the second train of coasters are configured to concurrently traverse the first and second layouts, respectively. The first train of coasters interacts with the second train of coasters along at least a portion of the first layout.

In accordance with a second aspect of the present disclosure, a roller coaster is provided that includes a first tower module, a second tower module, a first track defining a first layout spanning at least a portion of the first tower module, and a second track defining a second layout spanning at least a portion of the second tower module. At least a portion of the first layout and at least a portion of the second layout have a helical shape.

In accordance with a third aspect of the present disclosure, a modular roller coaster adapted to be installed in an environment includes a center module defined by a plurality of connectable center module sections configured for assembly in the environment, a first tower module defined by a plurality of connectable first tower sections configured for assembly in the environment, a first track defined by a plurality of connectable first track sections configured for assembly in the environment, and a second track defined by a plurality of connectable second track sections configured for assembly in the environment. One or more of the first track sections are disposed along a first portion of the center module and one or more of the first track sections are disposed along a first portion of the first tower module. One or more of the second track sections are disposed along a second portion of the center module and one or more of the second track sections are disposed along a second portion of the first tower module.

In accordance with a fourth aspect of the present disclosure, a method for assembling and installing a modular roller coaster in an environment includes obtaining user parameters for the modular roller coaster. The user parameters include at least one of a minimum age of a future rider of the modular roller coaster, a maximum speed of the modular roller coaster, and a duration of a ride of the modular roller coaster. The method further includes obtaining a plurality of connectable center module sections and obtaining a plurality of connectable first tower sections. The method further includes determining an arrangement of the center module sections and the first tower sections at least in part based on the user parameters and assembling the modular roller coaster to produce the determined arrangement. The assembling includes connecting the plurality of connectable center module sections to form a center module, connecting the plurality of connectable first tower sections to form a first tower module, and forming a first track defining a first layout. The first layout includes first track sections disposed along a first portion of the center module and a first portion of the first tower module. The assembling further includes forming a second track defining a second layout. The second layout includes second track sections disposed along a second portion of the center module and a second portion of the second tower module.

Advantages will become more apparent to those of ordinary skill in the art from the following description of the preferred embodiments which have been shown and described by way of illustration. As will be realized, the present embodiments may be capable of other and different embodiments, and their details are capable of modification in various respects. Accordingly, the drawings and description are to be regarded as illustrative in nature and not as restrictive.

BRIEF DESCRIPTION OF THE DRAWINGS

In order to complement the description being made and in order to assist in a better understanding of the features of the invention, in accordance with a preferred example of a practical embodiment thereof, a set of drawings is attached hereto as an integral part of the said description, in which the following is illustratively and non-limitingly depicted.

Figure 1:
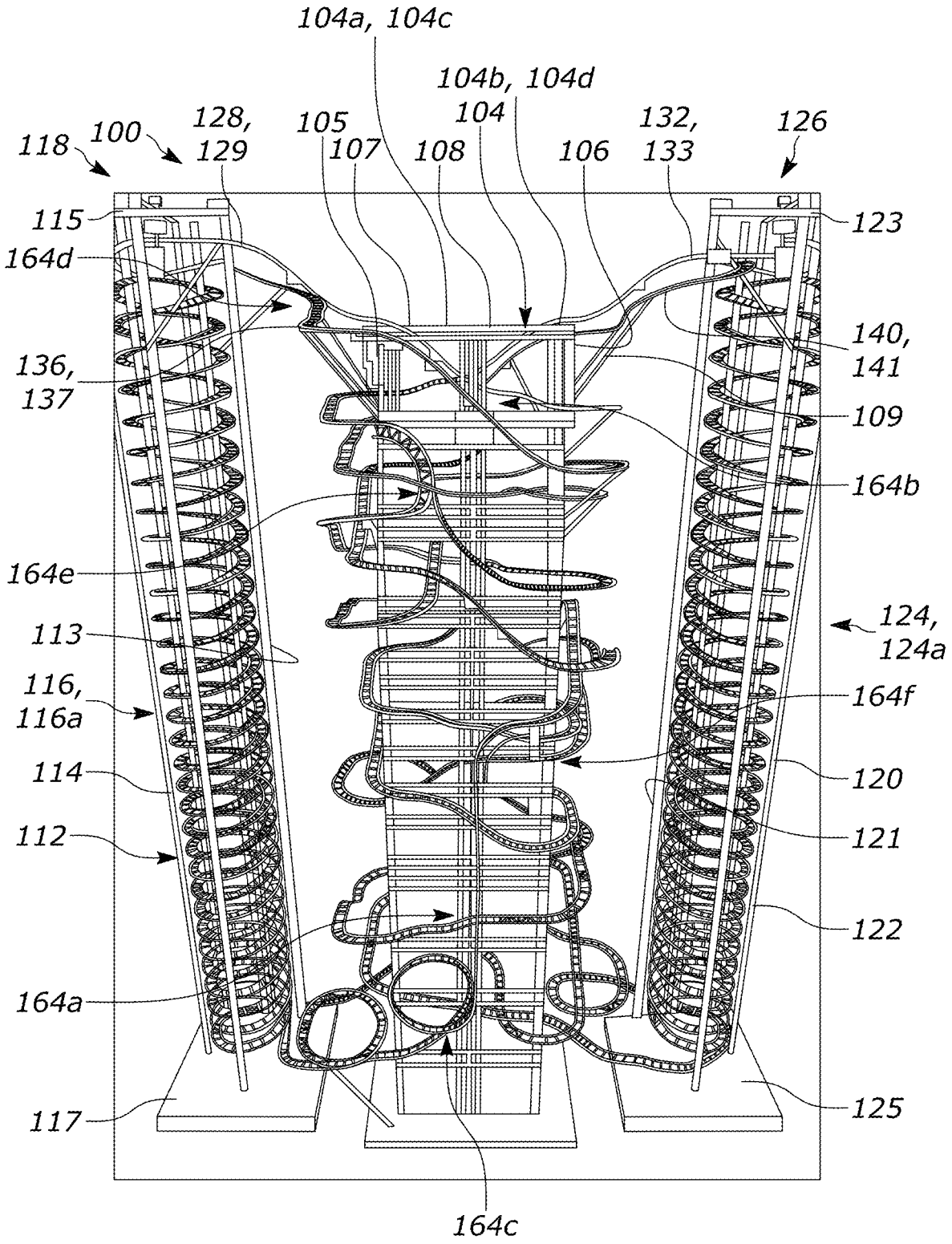
FIG. 1 is a front perspective view of one example of a roller coaster constructed in accordance with the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

The apparatus and method components have been represented where appropriate by conventional symbols in the drawings, showing only those specific details that are pertinent to understanding examples of the present disclosure so as not to obscure the disclosure with details that will be readily apparent to those of ordinary skill in the art having the benefit of the description herein.

Although the figures show parts with clean lines and boundaries, some or all of these lines and/or boundaries may be idealized. In reality, the boundaries and/or lines may be unobservable, blended, and/or irregular. Use of terms such as up, down, top, bottom, side, end, front, back, etc. herein are used with reference to a currently considered or illustrated orientation. If they are considered with respect to another orientation, it should be understood that such terms must be correspondingly modified.

DETAILED DESCRIPTION

The present disclosure aims to address problems related to the roller coasters discussed above, such as the designs disclosed in U.S. Pat. No. 8,893,623 ("the '623 Patent") and South Korea Patent No. 101,803,597. The '623 Patent, which describes a multi-track dueling roller coaster having tracks capable of having multiple coasters running simultaneously as a team, suffers from the large space footprint required to support the horizontal multi-track design, particularly when installed next to existing infrastructure. Moreover, this design focuses on vehicle synchronization and planned choreography, which improves consistency between runs but reduces the thrill of the rider after the first ride due to the predictability of the interactive materials. In contrast, the '597 Patent, which describes a tower-type roller coaster with a single spiral track having multiple vehicles running simultaneously, may reduce footprint due to the use of a vertical tower, but fails to provide the thrill typically provided by a dueling track design for any vehicle, much less multiple vehicles simultaneously traversing the track design.

Therefore, the present disclosure provides a roller coaster that is configured to reduce overall footprint through the use of vertical towers, while increasing the thrill of the rider through a dueling multi-track configuration having multiple vehicles traveling on each track. Additionally, the roller coaster disclosed herein has a modular design, such that the roller coaster can take advantage of variable park sizes and can be customized and scaled as needed to meet user specified parameters.

FIGS. 1-32 illustrate one example of a roller coaster 100 constructed in accordance with the teachings of the present disclosure. In this example, the roller coaster 100, which may also be referred to as a modular roller coaster, includes a center module 104, a first tower module 112, a second tower module 120, a first track 128, a second track 132, a first train of coasters 144, and a second train of coasters 148. The center module 104 includes a first side 105 and a second side 106 opposite the first side 105. The first tower module 112 is disposed adjacent the first side 105 of the center module 104. The second tower module 120 is disposed adjacent the second side 106 of the center module 106. The first track 128 defines a first layout 129 spanning at least a first portion 112*a* of the first tower module 112 and at least a first portion 104*a* of the center module 104. The second track 132 defines a second layout 133 spanning at least a first portion 120*a* of the second tower module 120 and at least a second portion 104*b* of the center module 104. The first train of coasters 144 are configured to movably traverse the first track 128. The second train of coasters 148 are configured to movably traverse the second track 132. The first train of coasters 144 and the second train of coasters 148 are configured to concurrently traverse the first and second layouts 129, 133, respectively. The first train of coasters 144 interacts with the second train of coasters 148 along at least a portion of the first layout 129.

In this example, the roller coaster 100 further includes a third track 136 (which may alternatively be referred to in the claims as the second track), a fourth track 140, a third train of coasters 152 (which may alternatively be referred to in the claims as the second train of coasters), and a fourth train of coasters 156. The third track 136 defines a third layout 137 spanning at least a second portion 112*b* of the first tower module 112 and at least a third portion 104*c* of the center module 104. The fourth track 140 defines a fourth layout 141 spanning at least a second portion 120*b* of the second tower module 120 and at least a fourth portion 104*d* of the center module 104. The third train of coasters 152 is configured to movably traverse the third track 136, whereas the fourth train of coasters 156 is configured to movably traverse the fourth track 140. The fourth train of coasters 156 may but need not interact with the third train of coasters 152 along at least a portion of the third layout 137.

Figure 3:
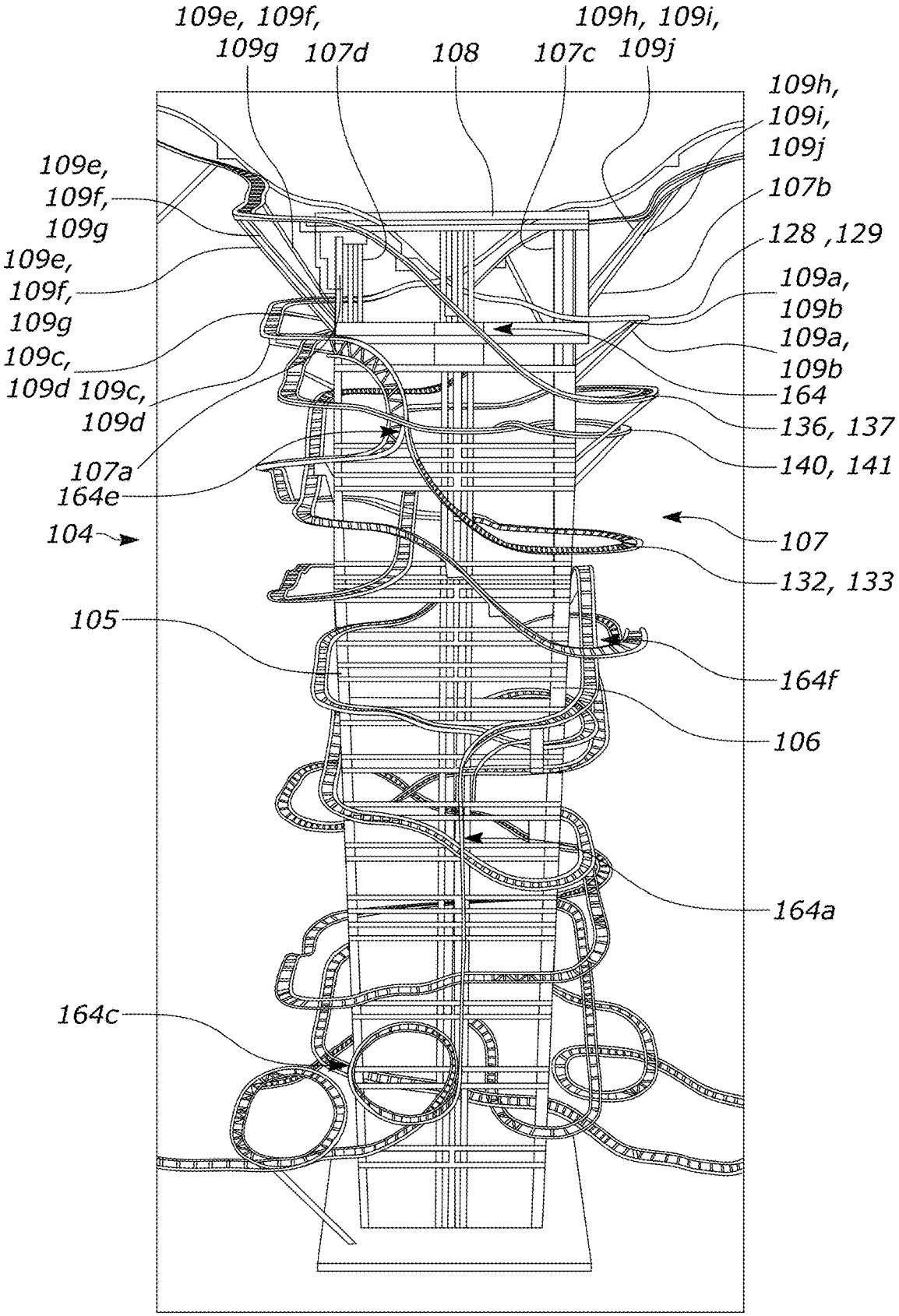
FIG. 3 is similar to FIG. 1 but only shows a central module of the roller coaster.
Figure 4:
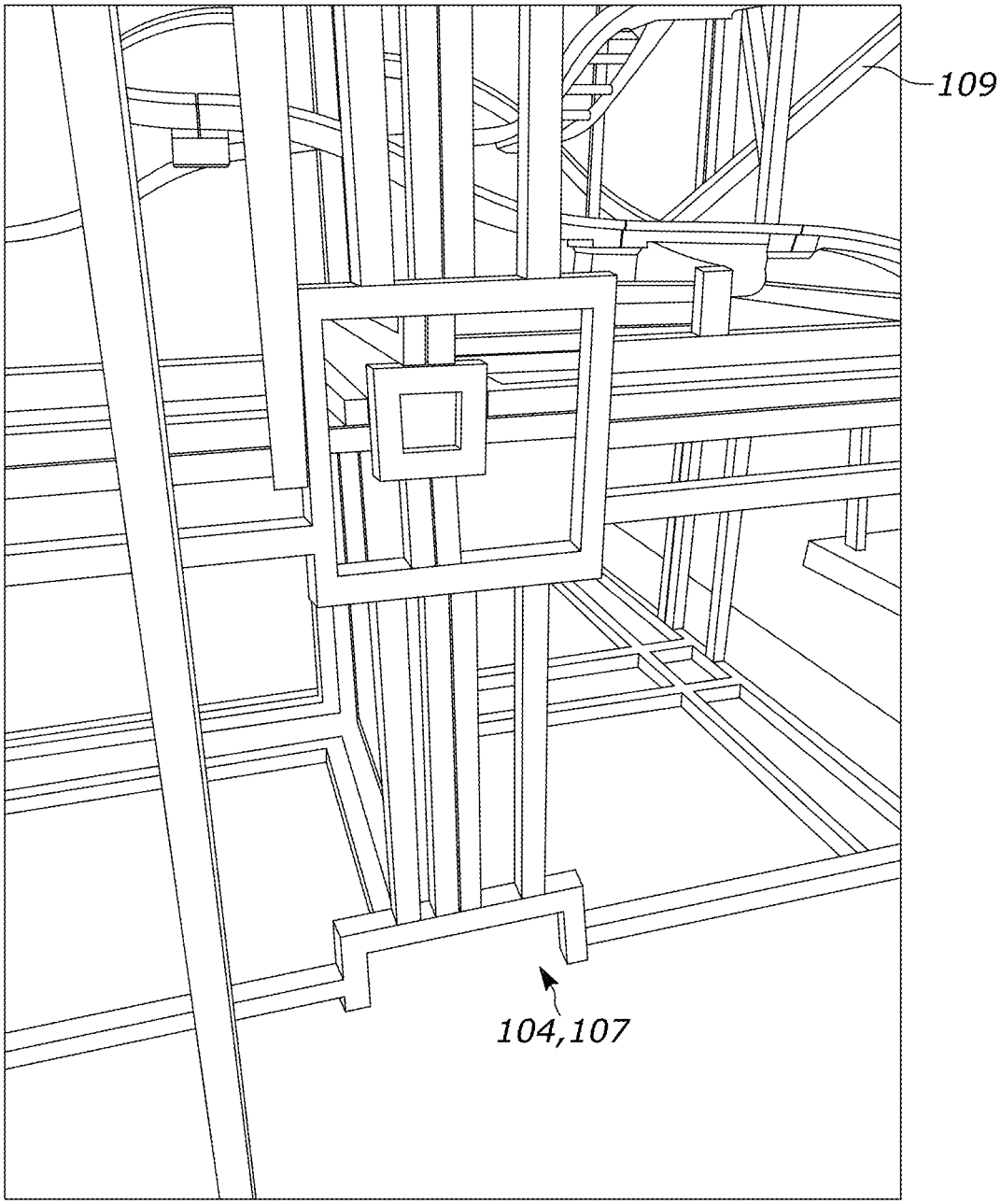
FIG. 4 is a first close-up view of the central module.
Figure 8:
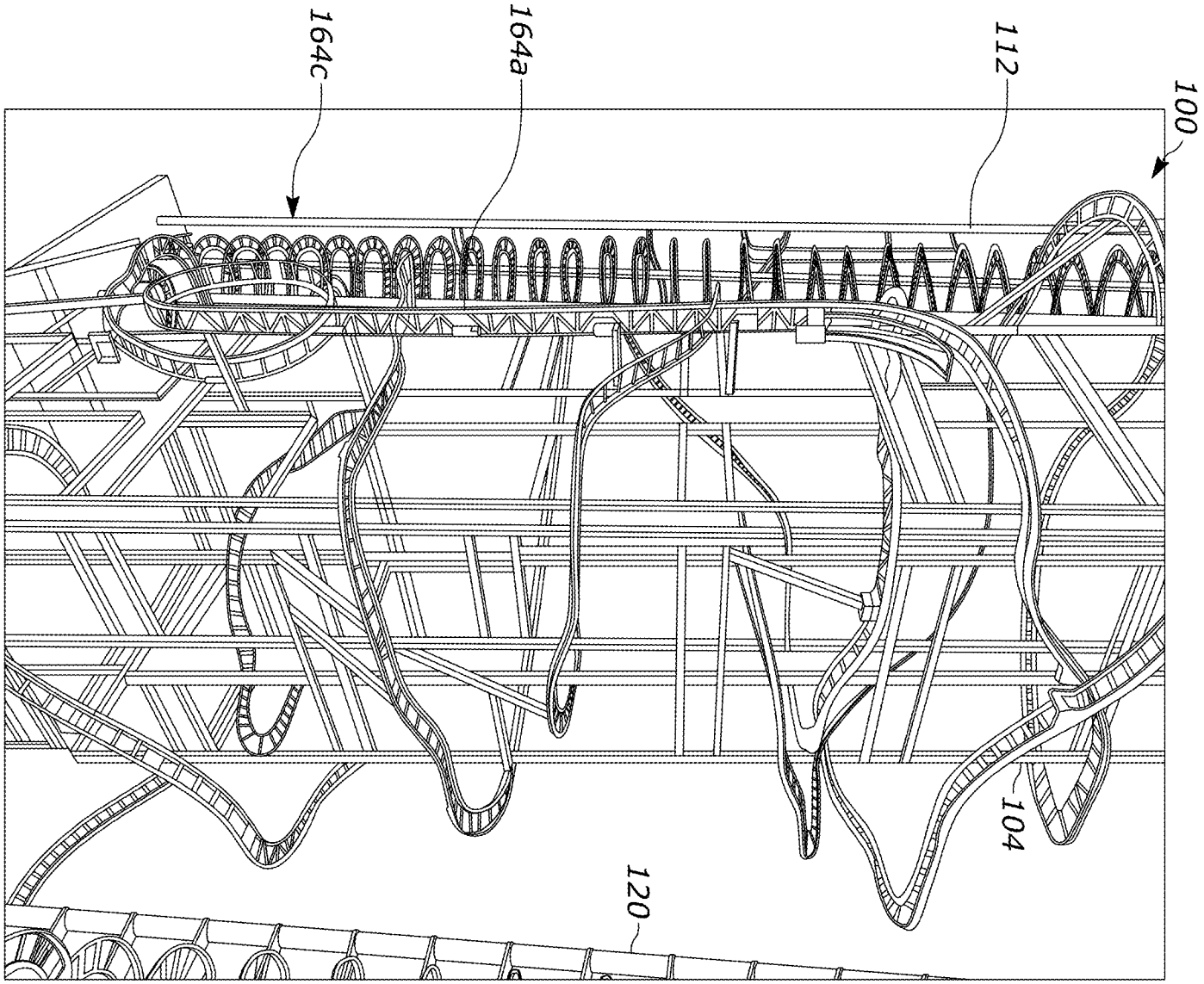
FIG. 8 is a second close-up view of the central module.
Figure 9:
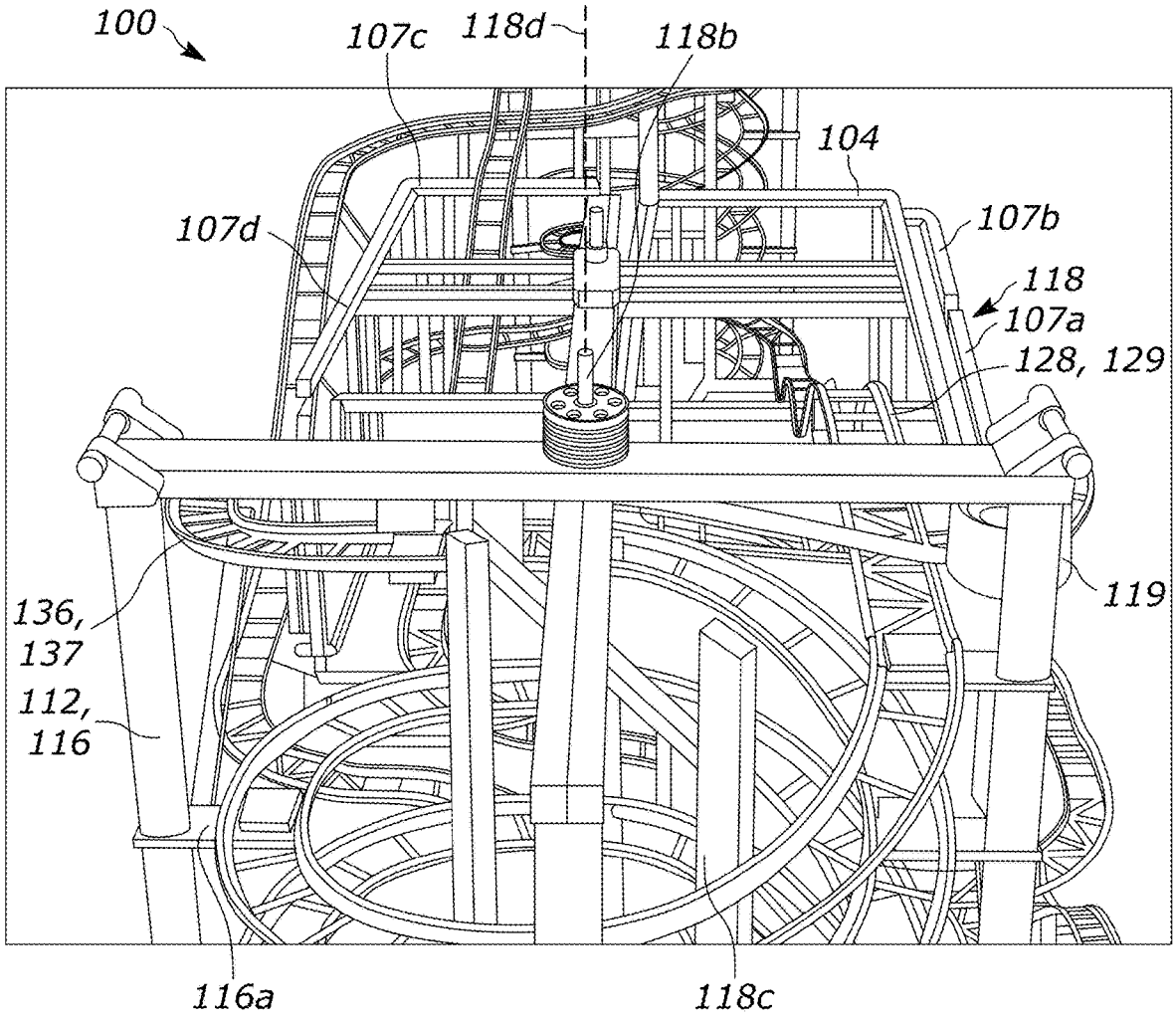
FIG. 9 is similar to FIG. 2 but shows a top of the roller coaster.

As best illustrated in FIG. 3, the center module 104 is generally configured for supporting and retaining at least a portion of each of the first, second, third, and fourth tracks 128, 132, 136, 140. In the present example, the center module 104 includes one or more connectable center module sections 107, and has a center module height 108. As best shown by FIG. 3, 4, or 8, the connectable center module sections 107 have a generally square shape defined by multiple frame members integrally formed with one another. It will be appreciated that each of the connectable center module sections 107 may be connected together by any suitable mechanism for releasable connection including, for example, a bolt and bearing, a pinned joint, a clamped joint, or any other fastener. The center module 104 further includes one or more extendable arms 109 releasably coupled to at least a portion of one or more of the connectable center module sections 107. The extendable arms 109, which are configured for supporting and retaining at least a portion of the first, second, third, or fourth tracks 128, 132, 136, 140, may extend away or into the center module 104, but are generally attached to the outer frame of one or more of the connectable center module sections 107 (and thus the center module 104). It will be appreciated that the frame of the connectable center module sections 107 and the extendable arms 109 are composed of any suitable rigid material including, for example, steel or aluminum.

Figure 2:
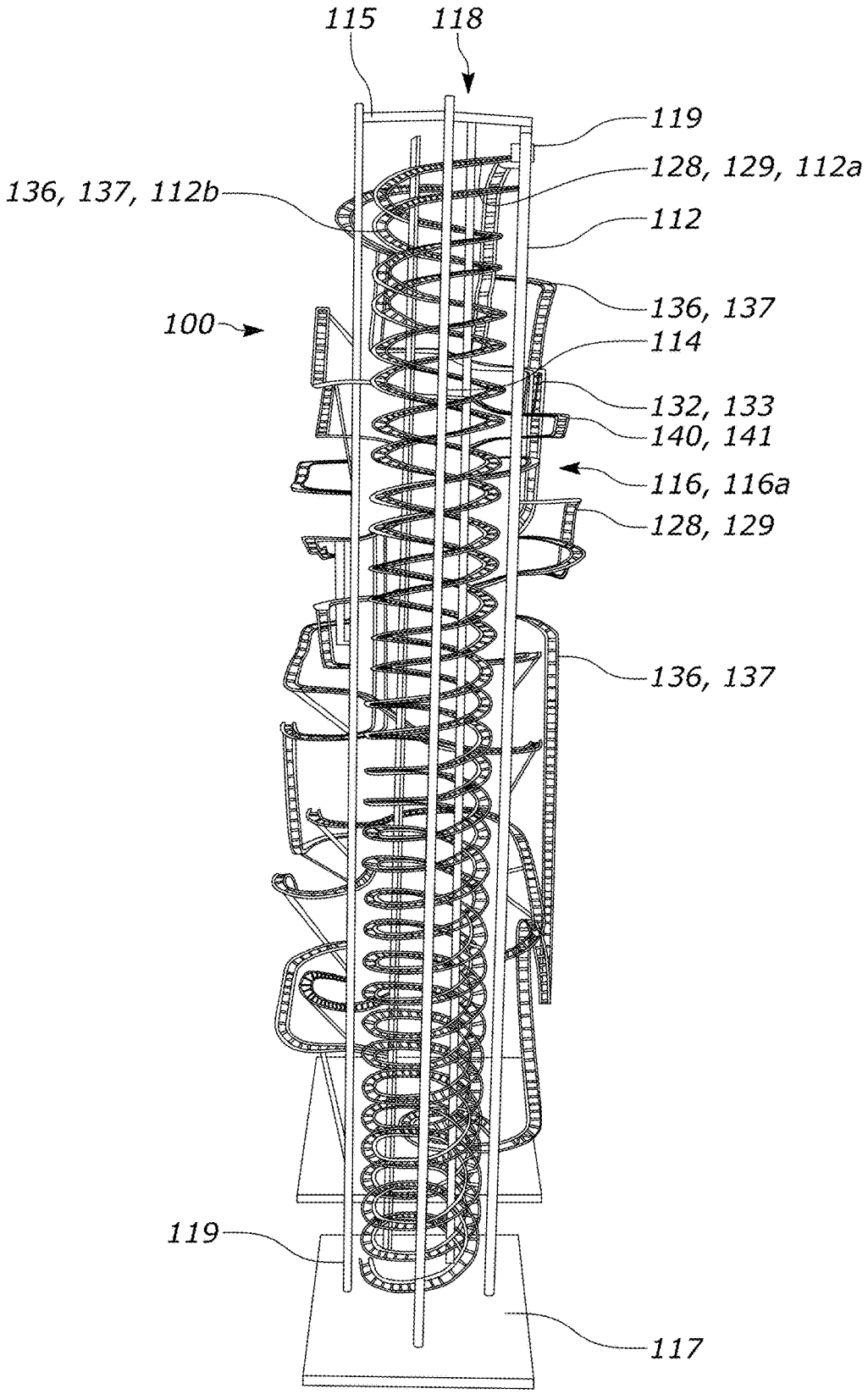
FIG. 2 is a left side perspective view of the roller coaster of FIG. 1.
Figure 5:
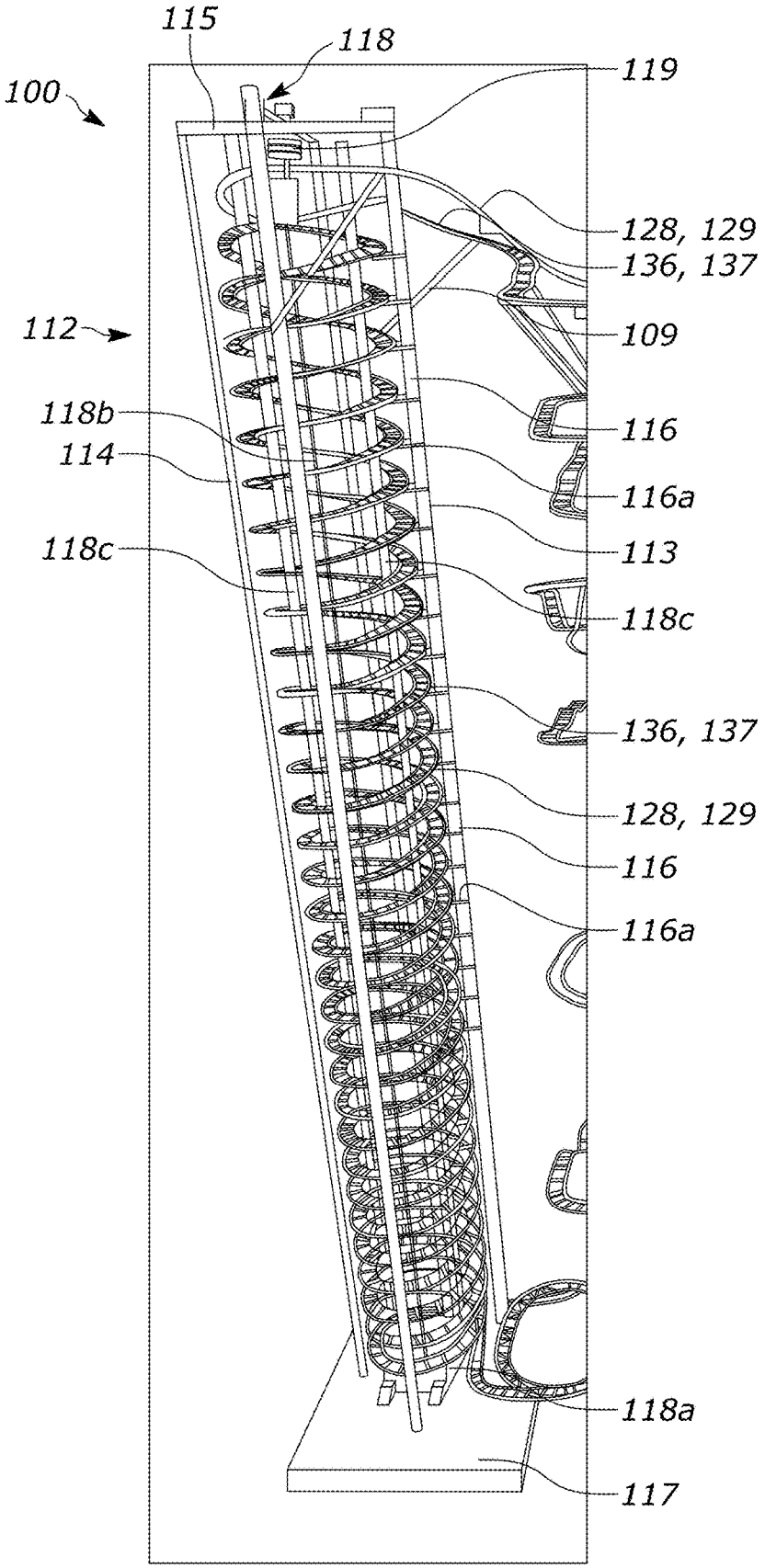
FIG. 5 is a front perspective view of a first tower module of the roller coaster of FIG. 1.
Figure 7:
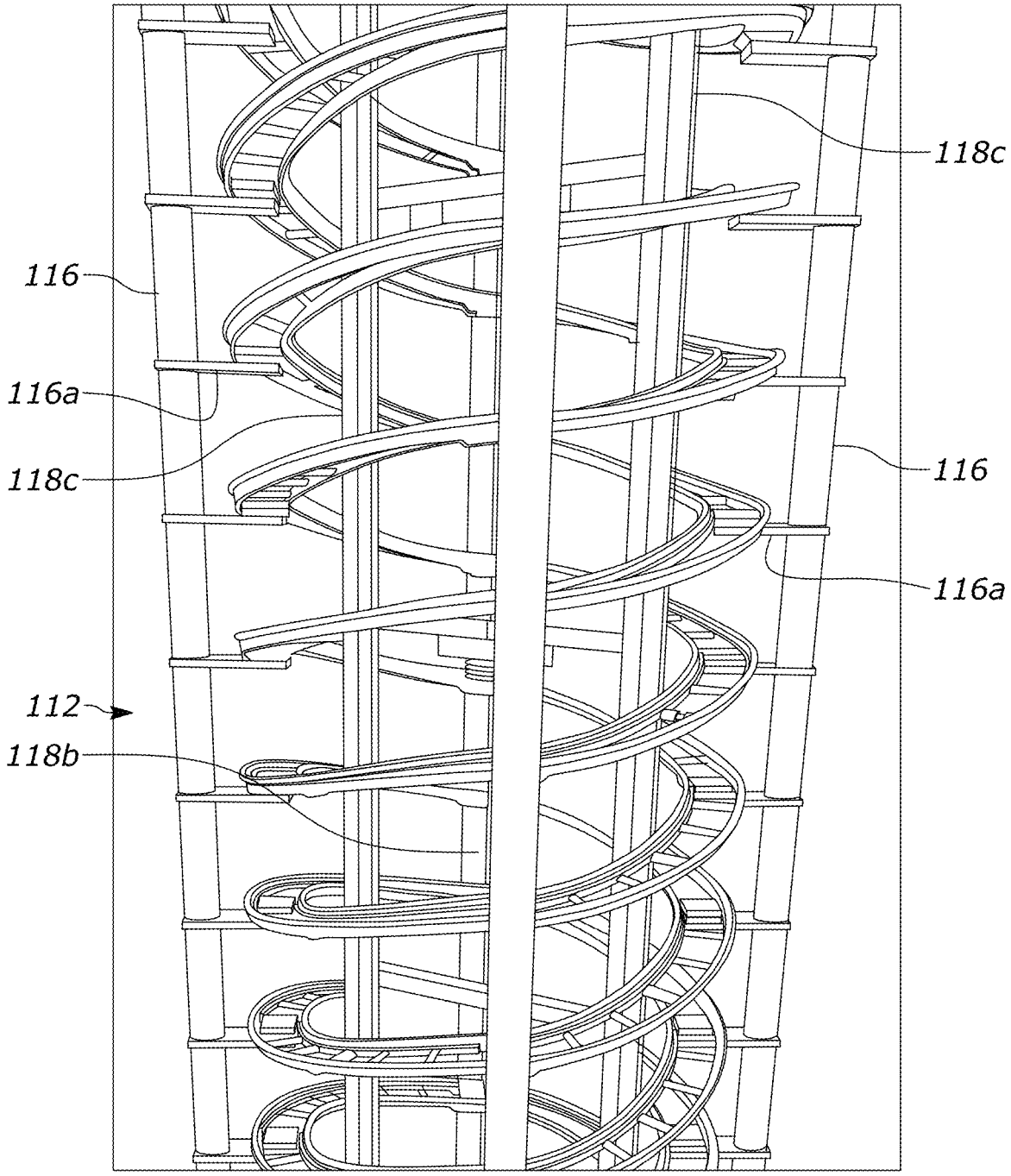
FIG. 7 is a close-up view of a portion of the first tower module.

As best shown by FIGS. 2 and 5, the first tower module 112 is generally configured for supporting and retaining at least a portion of the first and third tracks 128, 136. In the present example, the first tower module 112 is a spiral lift tower and includes a first inner edge 113 disposed adjacent the first side 105 of the center module 104 and a first outer edge 114 disposed opposite the first inner edge 113. The first tower module 112 has a first tower module height 115 defined between a first, or top, end and a second, or bottom, end of the first tower module 112 and further includes one or more connectable first tower sections 116 and a base 117 that supports the tower sections 116, which extend in a vertical direction upwards from the base 117. In the present example, the first tower module height 115 is greater than the center module height 108. In other examples, the first tower module height 115 may be less than or equal to the center module height 108. In the present example, each of the connectable first tower sections 116 has a generally rectangular shape. In other examples, however, the first tower sections 116 may have a different shape (e.g., a circular, a triangular, or irregular shape). Moreover, each of the connectable first tower sections 116 includes one or more support arms 116*a* extending into the first tower module 112 and configured for supporting and retaining a portion of the first track 128 or the third track 136 disposed within the first tower module 112. In the present example, each of the connectable first tower sections 116 includes two support arms 116*a*, a first one that is configured for supporting and retaining a portion of the first track 128 and a second one that is opposite the first one and is configured for supporting and retaining a portion of the third track 136. As best shown in FIG. 7, each connectable first tower section 116 includes the horizontal space between each respective set of support arms 116*a* and the vertical space above or below each respective set of support arms 116*a*. It will be appreciated that the connectable first tower sections 116 are formed of any suitable rigid material including, for example, steel or aluminum. Moreover, in the present example, the connectable first tower sections 116 may be connected together by any suitable mechanism for releasable connection including, for example, a bolt and bearing, a pinned joint, a clamped joint, or any other fastener. In the present example, the base 117 is generally configured for supporting the first tower module 112 and housing electrical or other components of the first tower module 112. The base 117 may be of any suitable shape (e.g., square, rectangle), but it will be appreciated that the base 117 will generally be wider than the first tower module 112. However, the first tower module 112 need not include the base 117, in which case one of the first tower sections 116 can be directly mounted to a surface (e.g., a ground surface) in the environment.

As shown in FIGS. 9-13, the first tower module 112 further includes a first lift mechanism 118 configured for facilitating vertical movement of the first train of coasters 144 and the third train of coasters 152 along the first and third tracks 128, 136, respectively. In the present example, the lift mechanism 118 is a spiral lift mechanism extending through the center of the first tower module from the base 117 to at least the top end of the first tower module 112. In particular, the lift mechanism 118 is a central drive shaft system having a motor 118*a*, a central rod 118*b* rotatably coupled to the motor 118*a*, and one or more carrier arms 118*c* configured for rotating with the central rod 118*b*. It will be appreciated that the motor 118*a* may be any mechanical or electrical motor configured for creating rotation along a central axis 118*d* coaxial with the central rod 118*b*. Moreover, although in the present example the motor 118*a* is disposed adjacent the base 117, in other examples the motor 118*a* may disposed at any point along the central rod 118*b* or adjacent the top end of the first tower module 112. In the present example, the central rod 118*b* is composed of a rigid, metal rod extending from motor 118*a* through the center of the first tower module 112 to the top end of the first tower module 112. Moreover, at least a portion of the central rod 118*b* (in this example, the bottom of the central rod 118*b*) is disposed within the motor 118*a* such that the motor 118*a* can rotate the central rod 118*b* around the central axis 118*d* of the first tower module 112. In other examples, the motor 118*a* may rotate the central rod 118*b* without the central rod 118*b* being disposed within the motor 118*a* (e.g., the central rod 118*b* can instead be disposed adjacent the outer edge of the motor). In the present example, the lift mechanism 118 includes two carrier arms 118*c* fixedly coupled to the central rod 118*b*. In particular, each of the carrier arms 118*c* are disposed opposite each other at a position radially outward from the central axis 118*d* of the first tower module 112 and the central rod 118*b*. The carrier arms 118*c* extend along at least a portion of the length of the central rod 118*b*. In other examples, the lift mechanism 118 may instead include 1, 3, 4, or more carrier arms 118*c*, and the carrier arms 118*c* may extend more or less along the central rod 118*b* than in the present example. In any event, the carrier arms 118*c* are disposed away from the central rod 118*b* such that each of the carrier arms 118*c* is disposed immediately adjacent the first and third tracks 128, 136. Further details regarding the carrier arms 118*c* will be discussed below.

Figure 10:
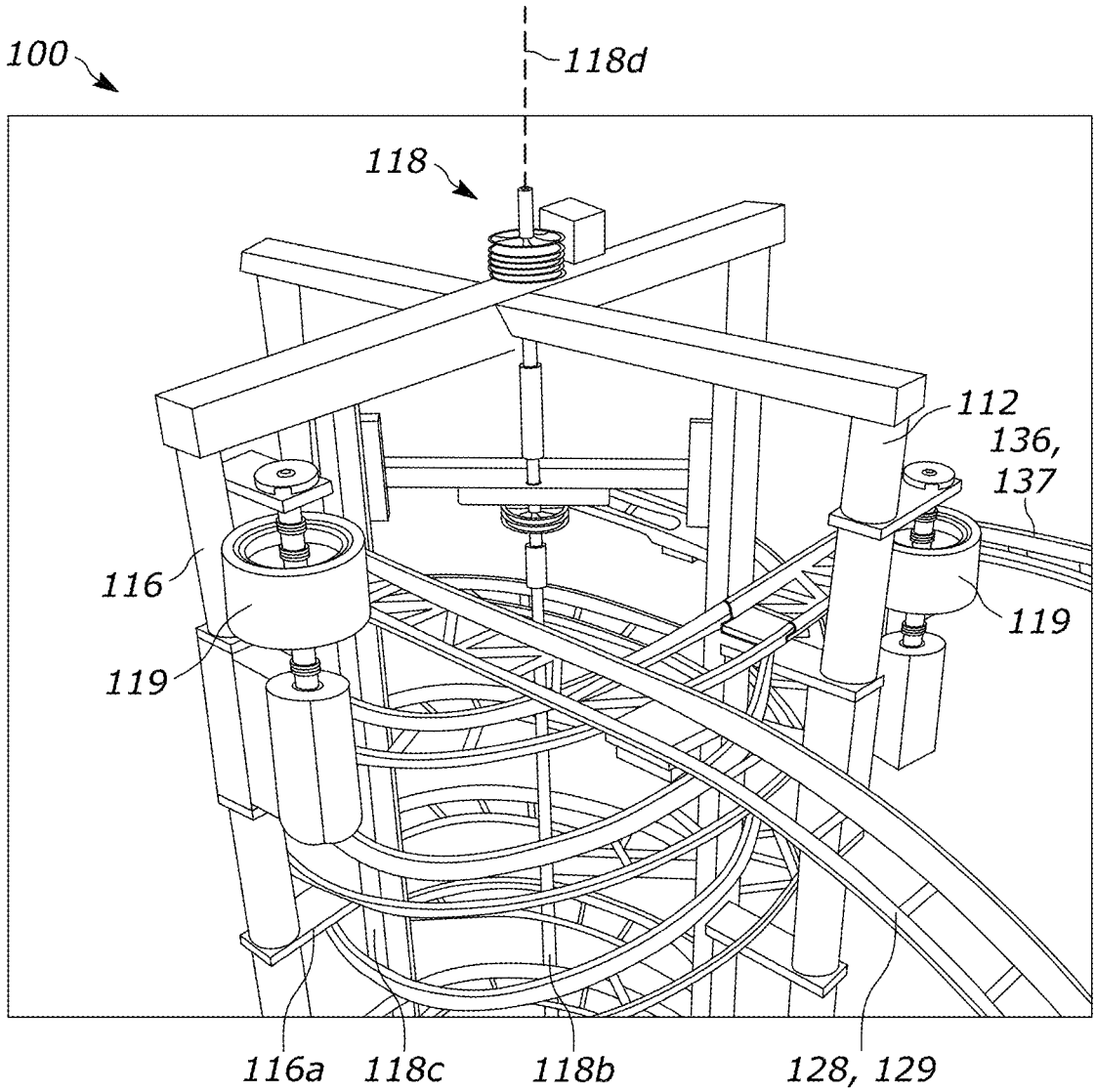
FIG. 10 is a close-up view of a top portion of the first tower module.
Figure 11:
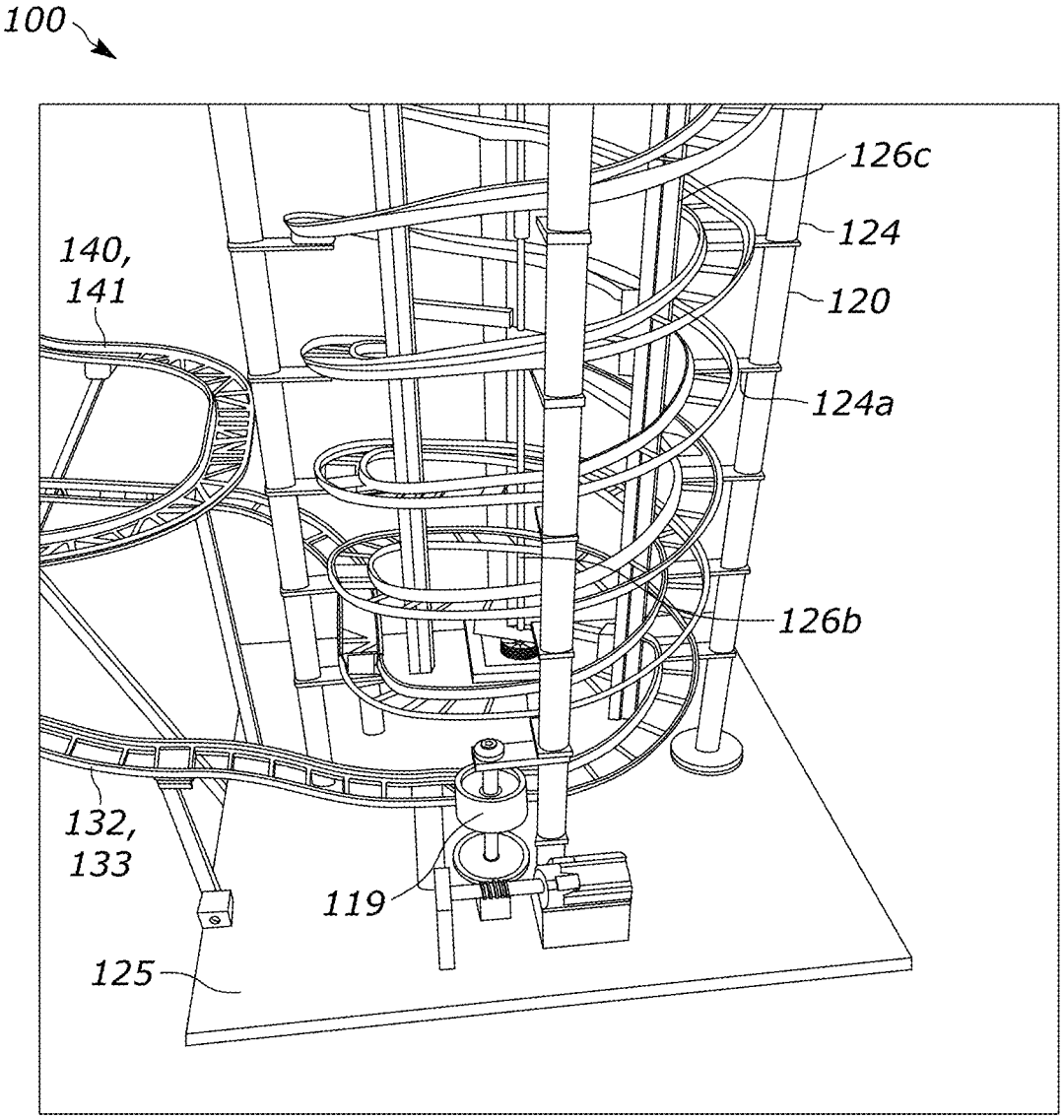
FIG. 11 is a close-up view of a bottom portion of the first tower module.
Figure 12:
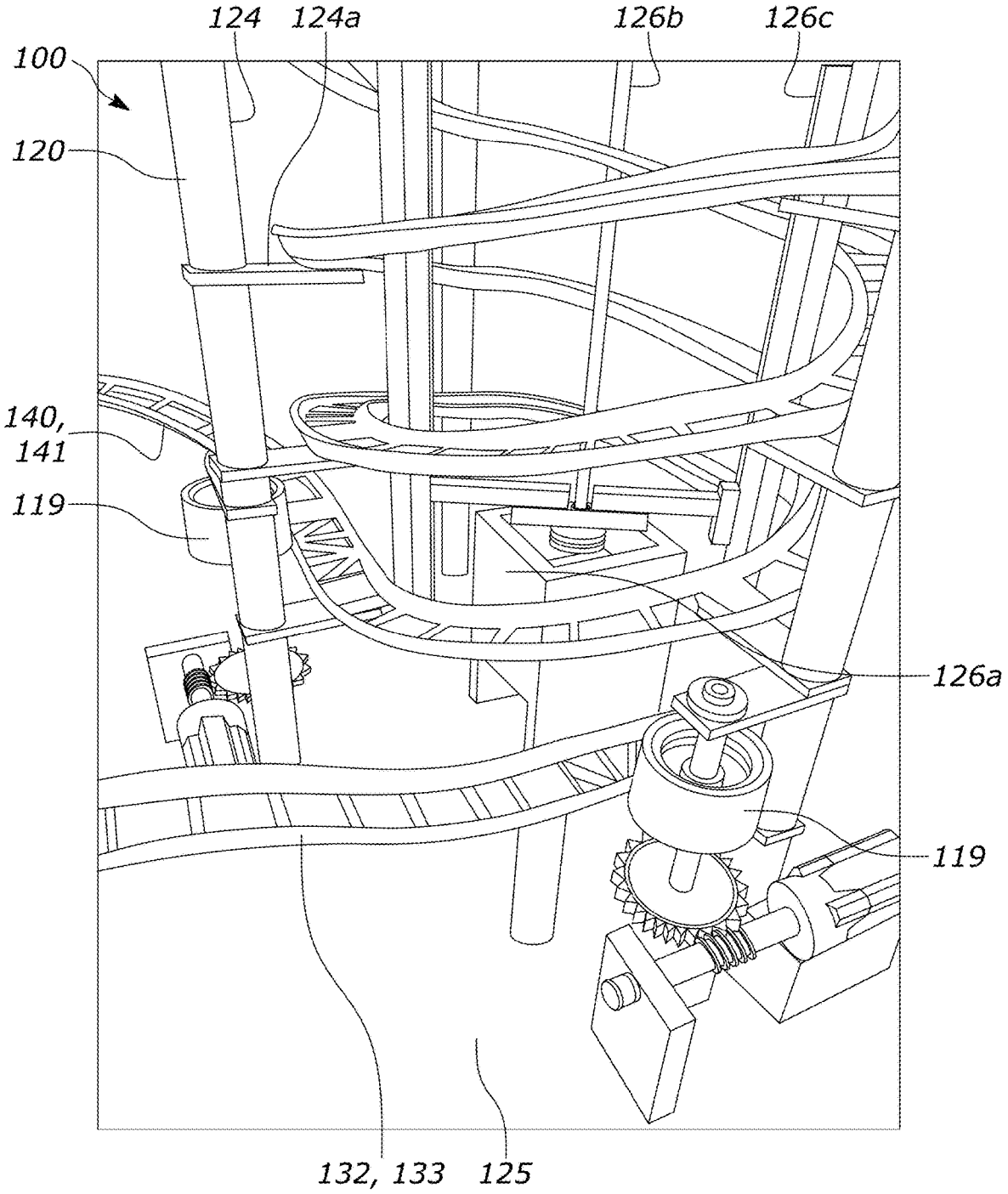
FIG. 12 is a first close-up view of a bottom portion of the second tower module.
Figure 13:
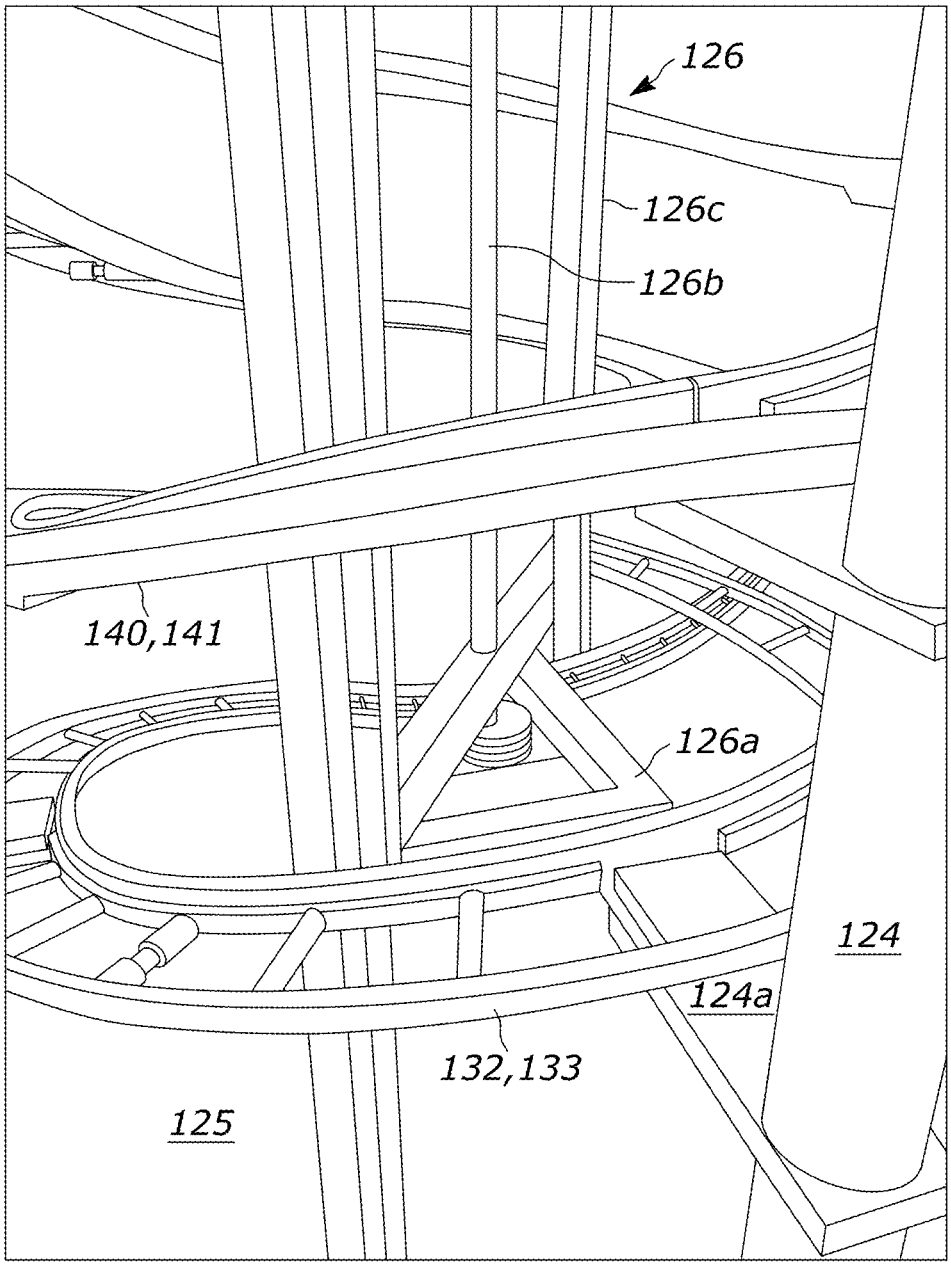
FIG. 13 is a second close-up view of the bottom portion of the second tower module.
Figure 14:
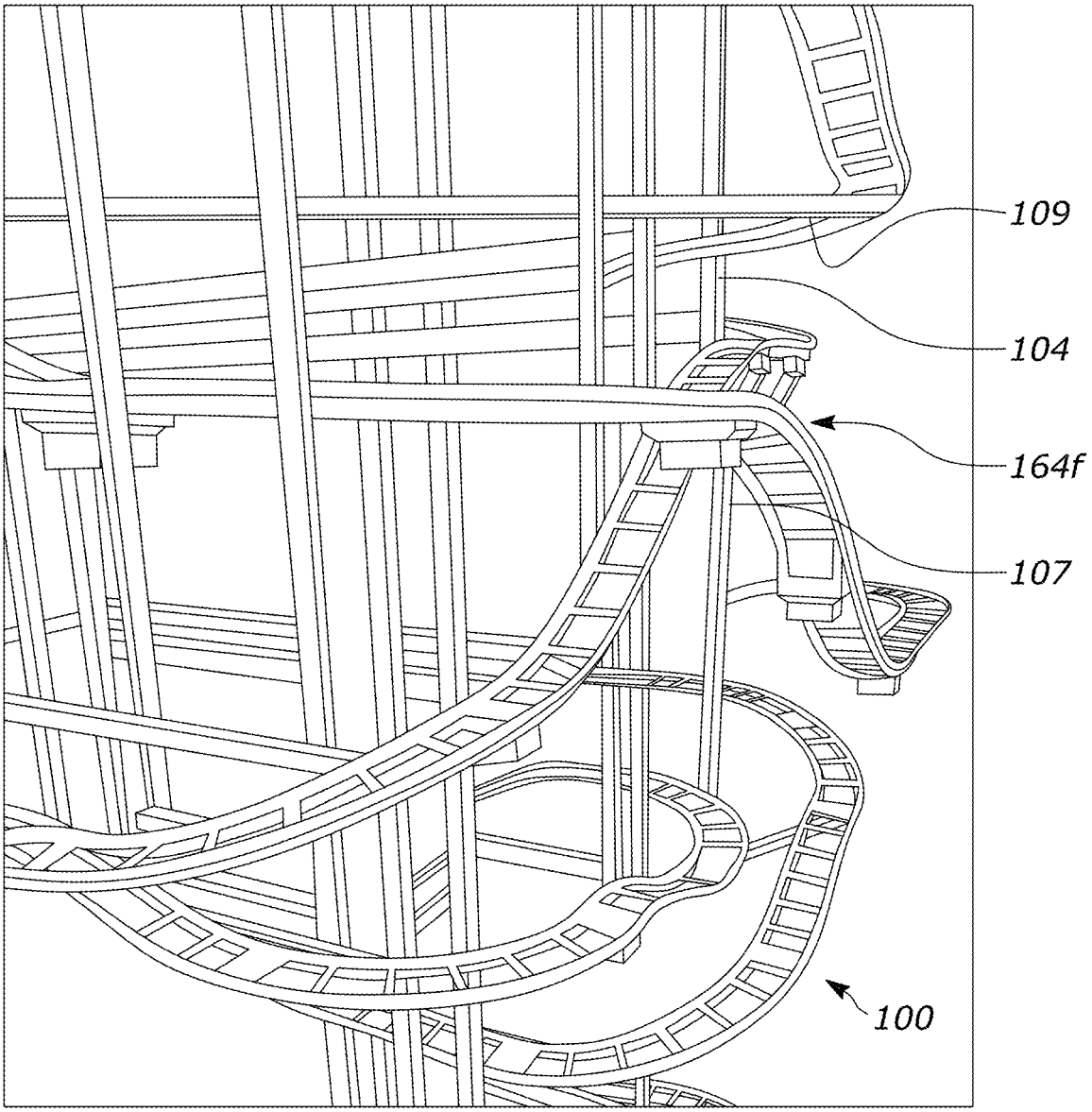
FIG. 14 is a first close-up view of a middle portion of the center module, showing a plurality of tracks of the roller coaster traversing the center module.
Figure 15:
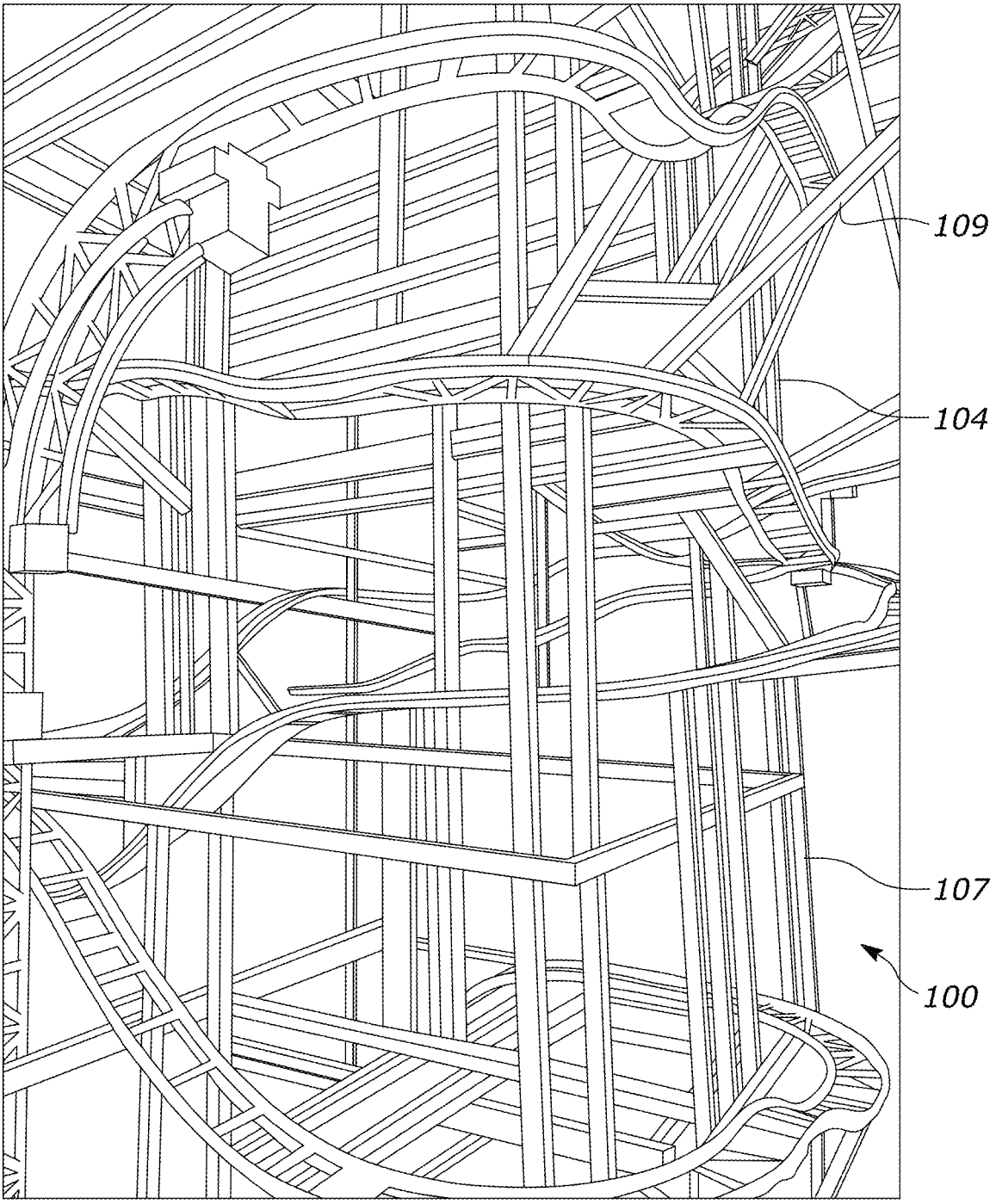
FIG. 15 is a second close-up view of the middle portion of the center module, showing the plurality of tracks of the roller coaster traversing the center module.
Figure 16:
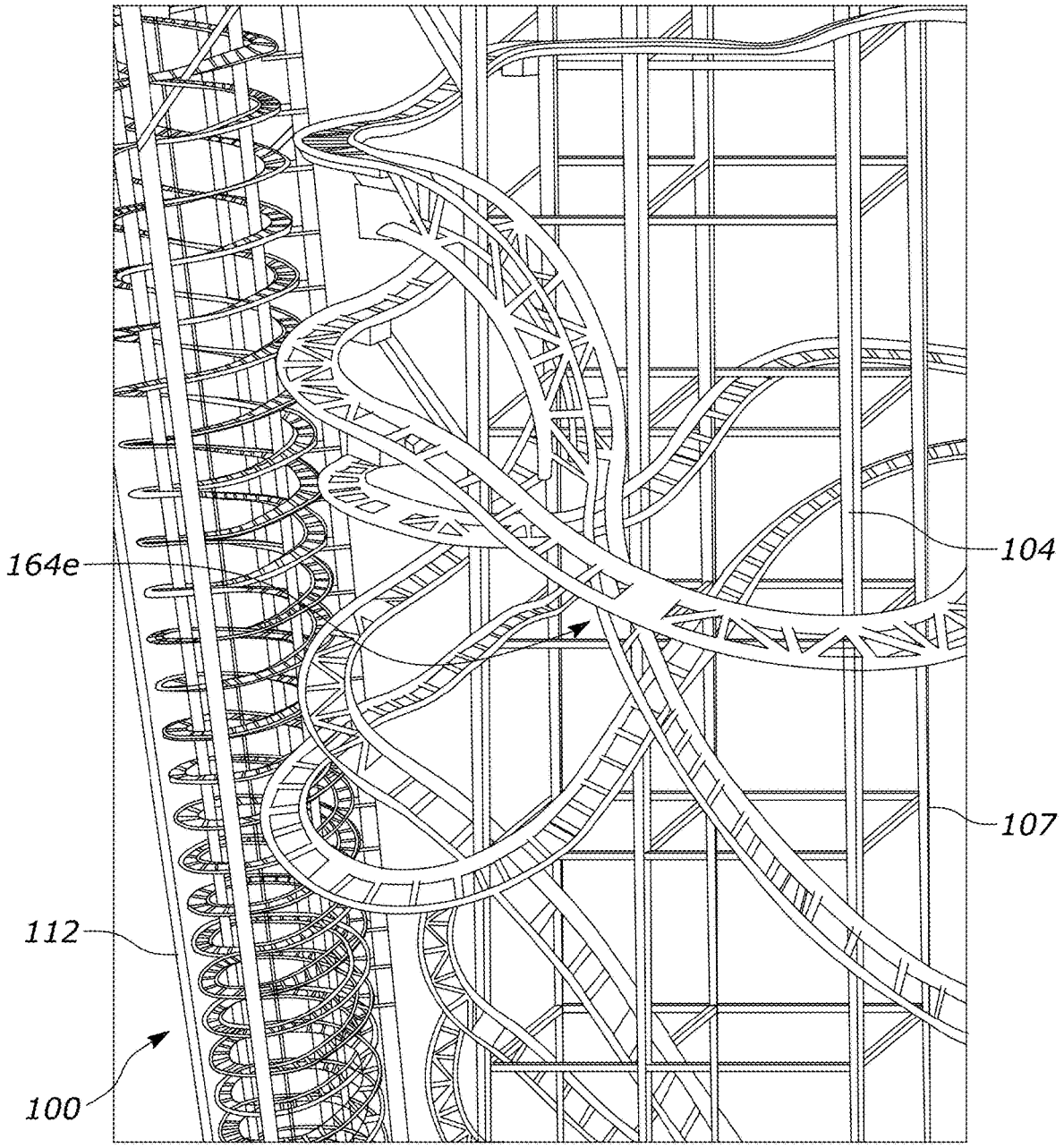
FIG. 16 shows first and third tracks of the roller coaster traversing the first tower module and the center module.
Figure 17:
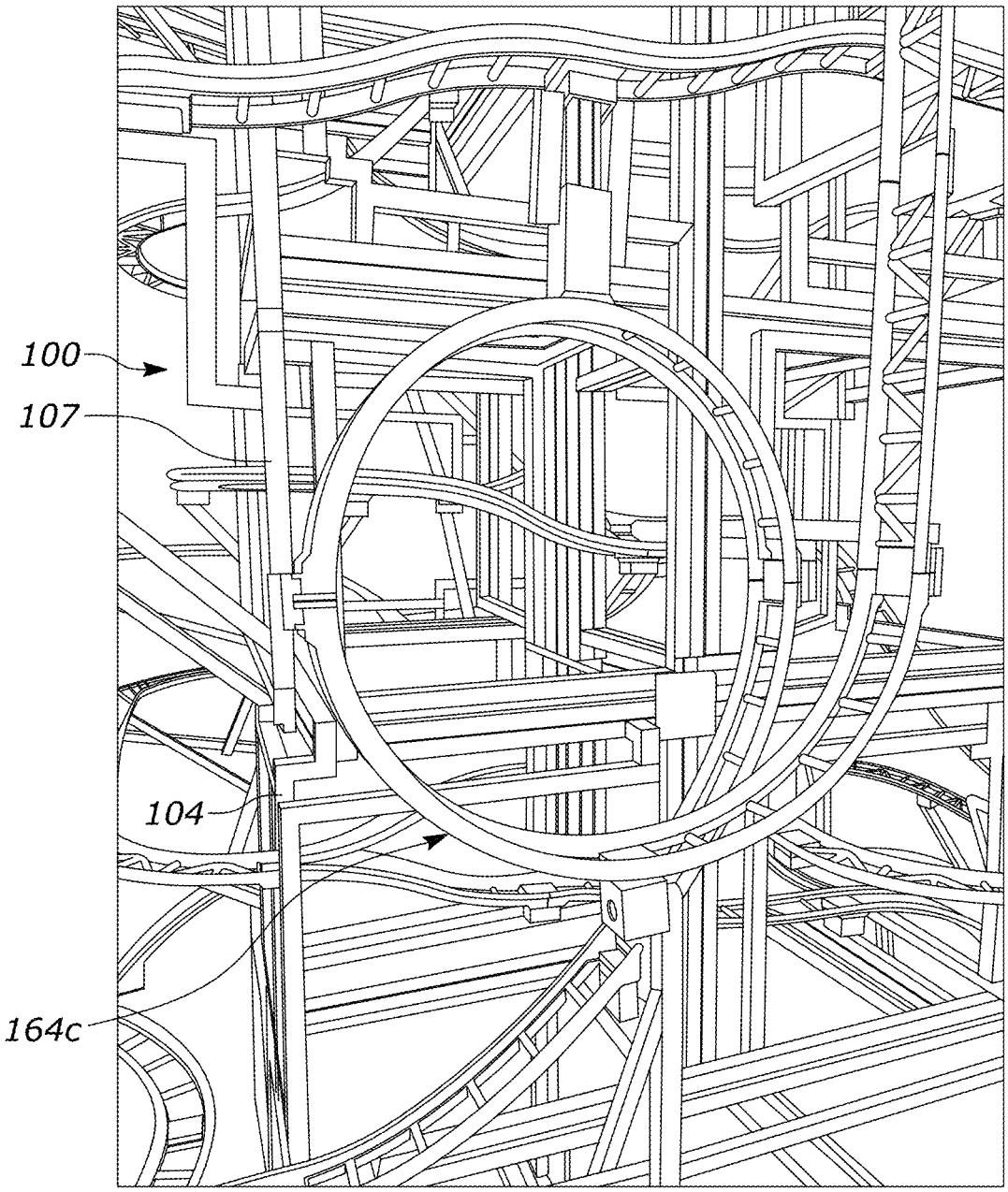
FIG. 17 is a third close-up view of the middle portion of the center module, showing the plurality of tracks of the roller coaster traversing the center module.
Figure 18:
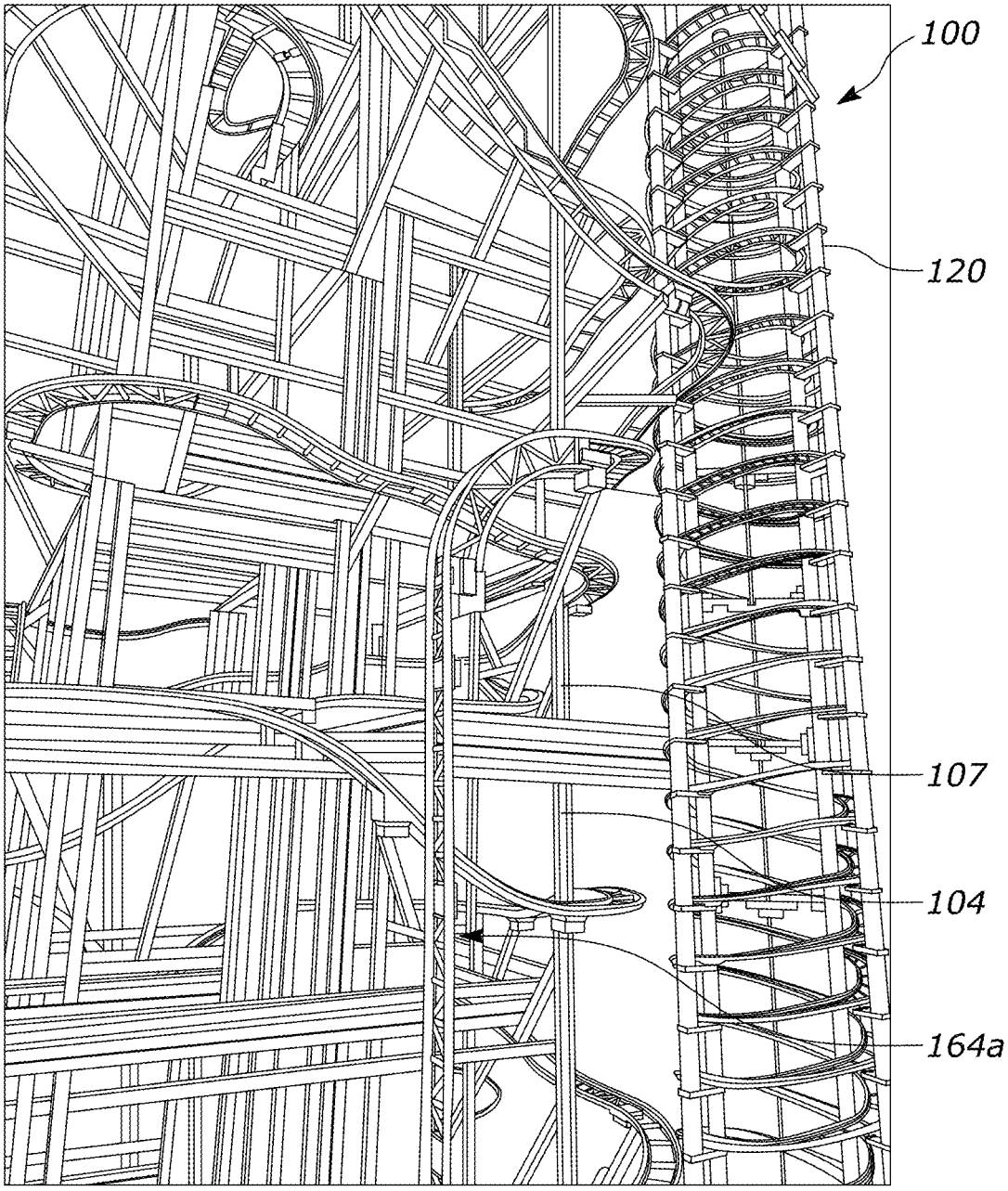
FIG. 18 shows second and fourth tracks of the roller coaster traversing the second tower module and the center module.
Figure 19:
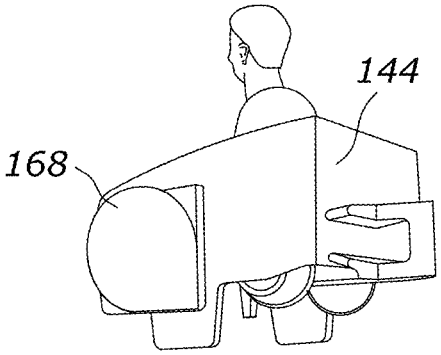
FIG. 19 is a rear perspective view of one coaster of a train of coasters of the roller coaster.
Figure 20:
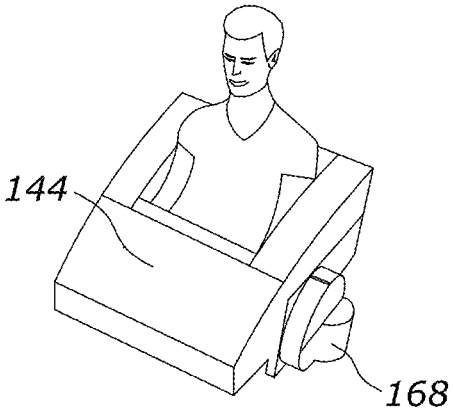
FIG. 20 is a first front perspective view of FIG. 19.
Figure 21:
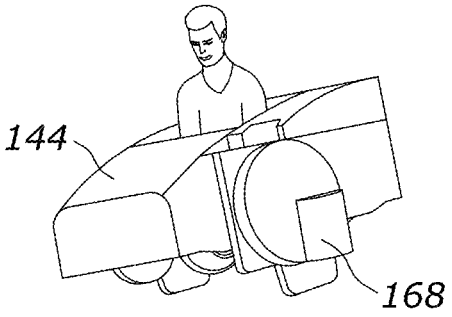
FIG. 21 is a second front perspective view of FIG. 19.
Figure 22:
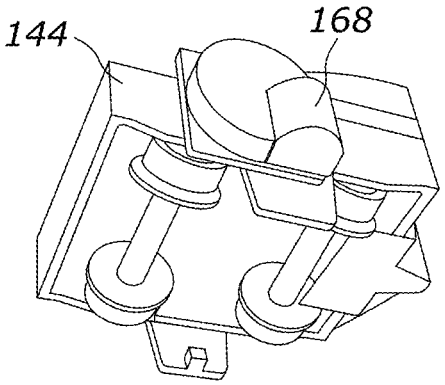
FIG. 22 is a bottom perspective view of FIG. 19.
Figure 23:
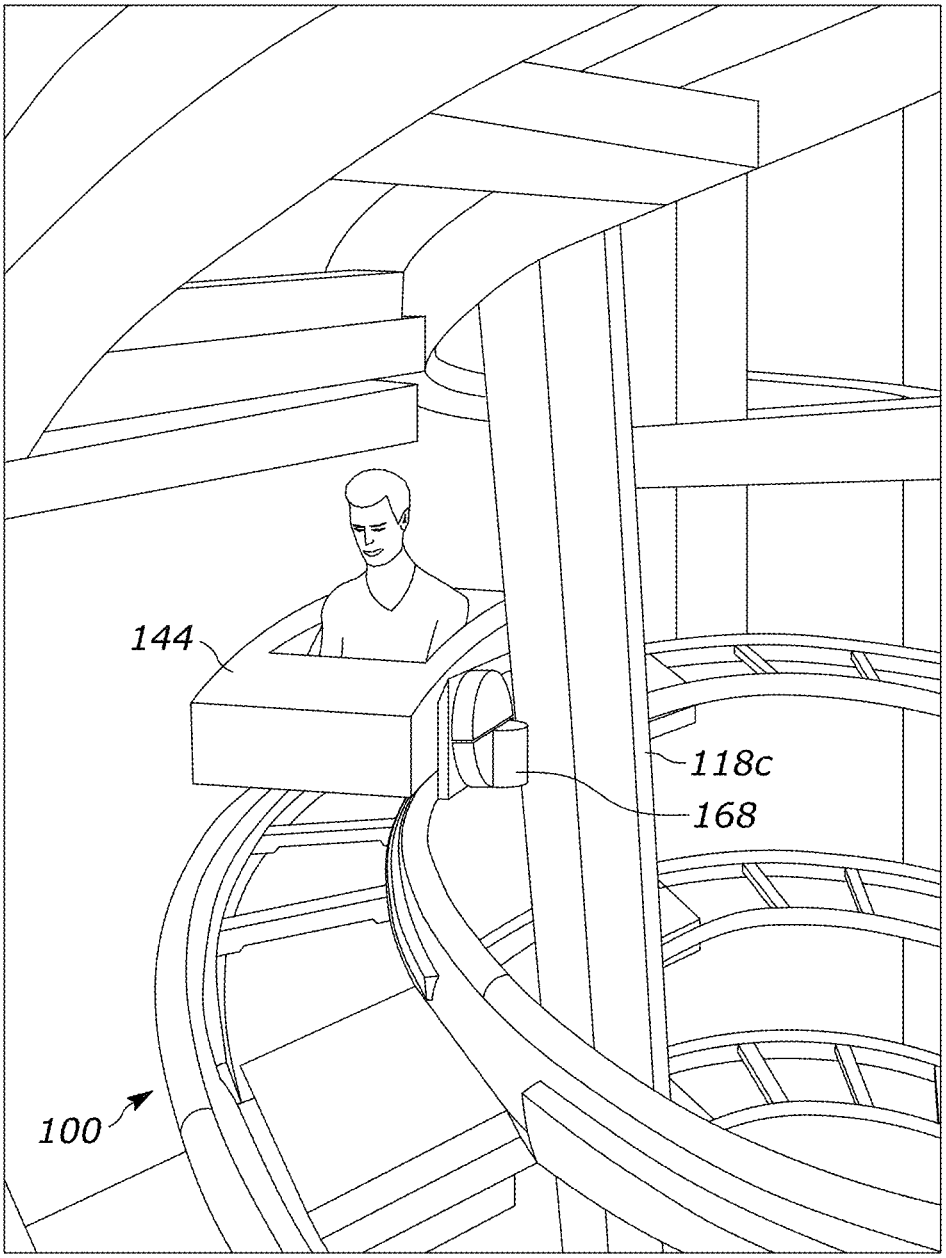
FIG. 23 is a close-up front view of a first train of coasters traversing a portion of the first track.
Figure 24:
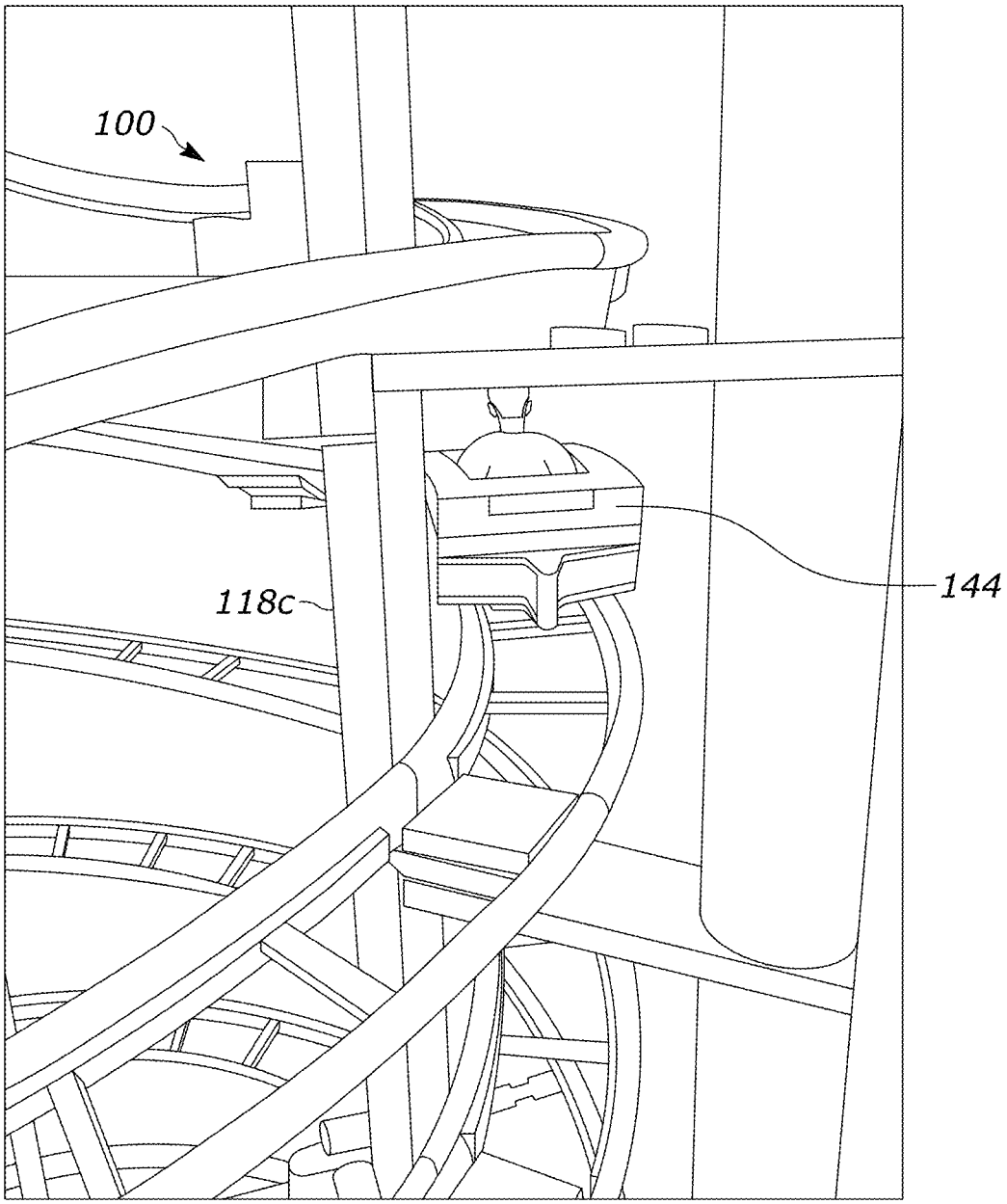
FIG. 24 is a close-up rear view of FIG. 23.
Figure 25:
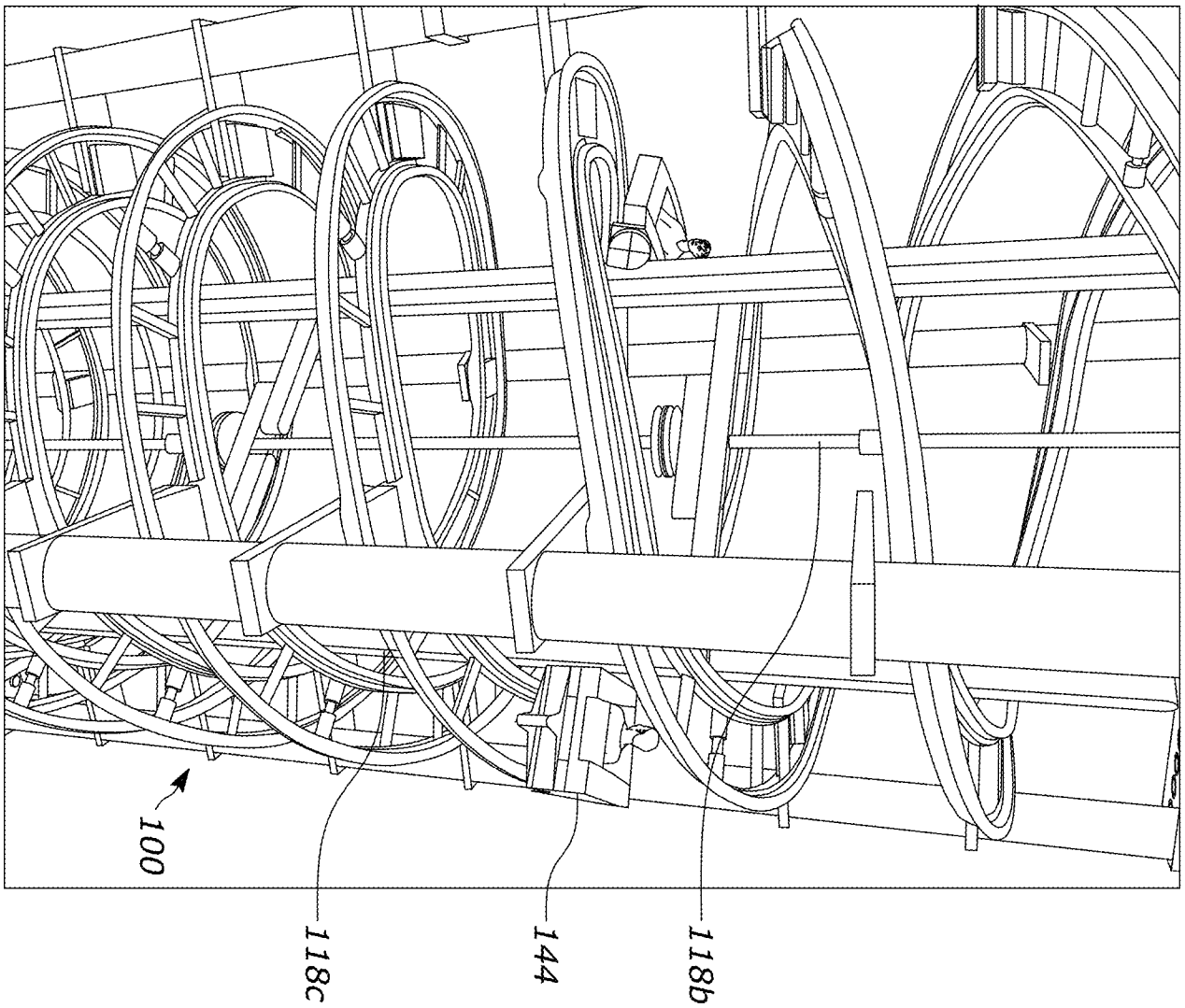
FIG. 25 illustrates the first train of coasters and a third train of coasters concurrently traversing the first track and a third track of the roller coaster, respectively.
Figure 26:
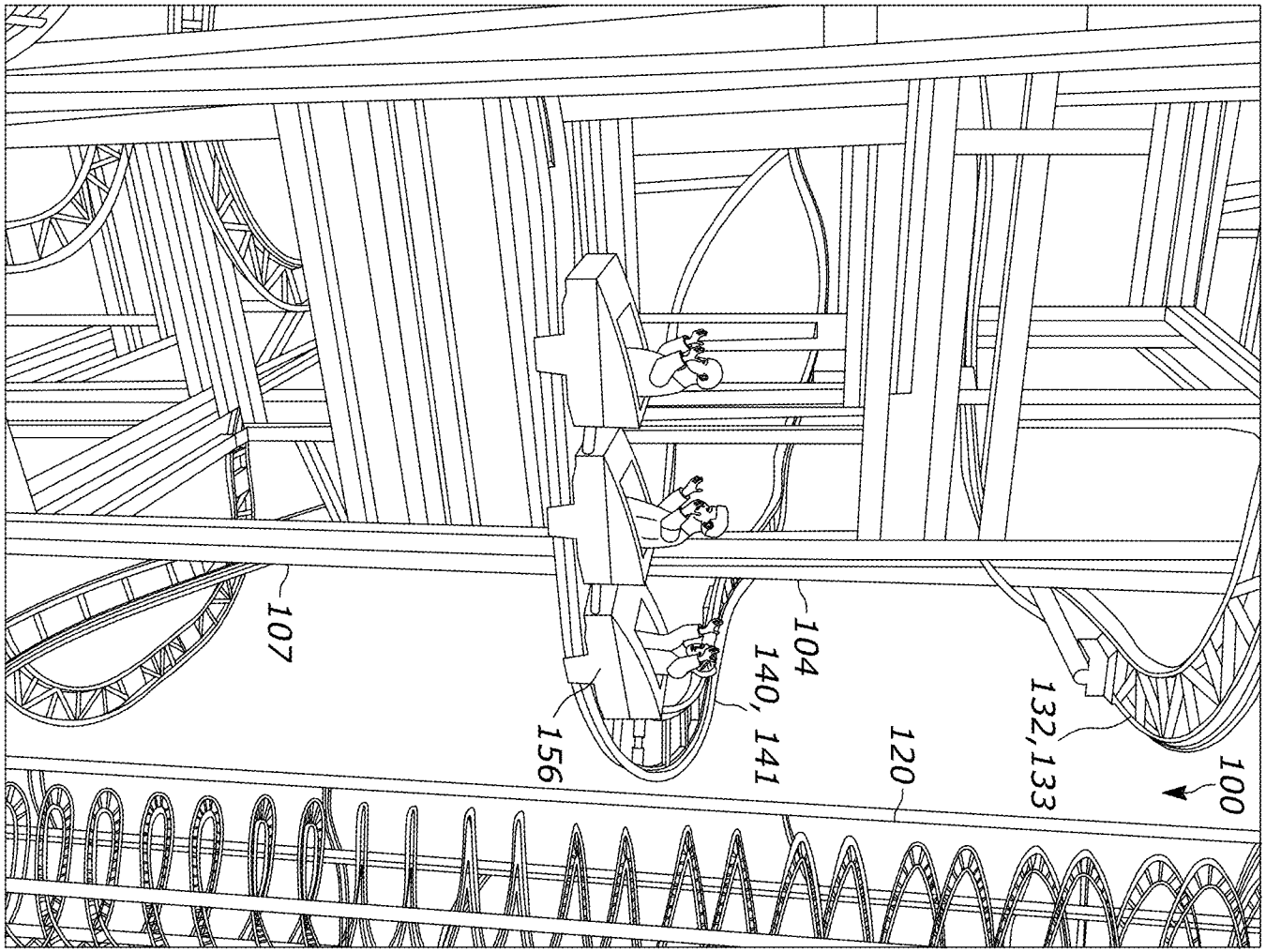
FIG. 26 illustrates a fourth train of coasters traversing a fourth track of the roller coaster.
Figure 27:
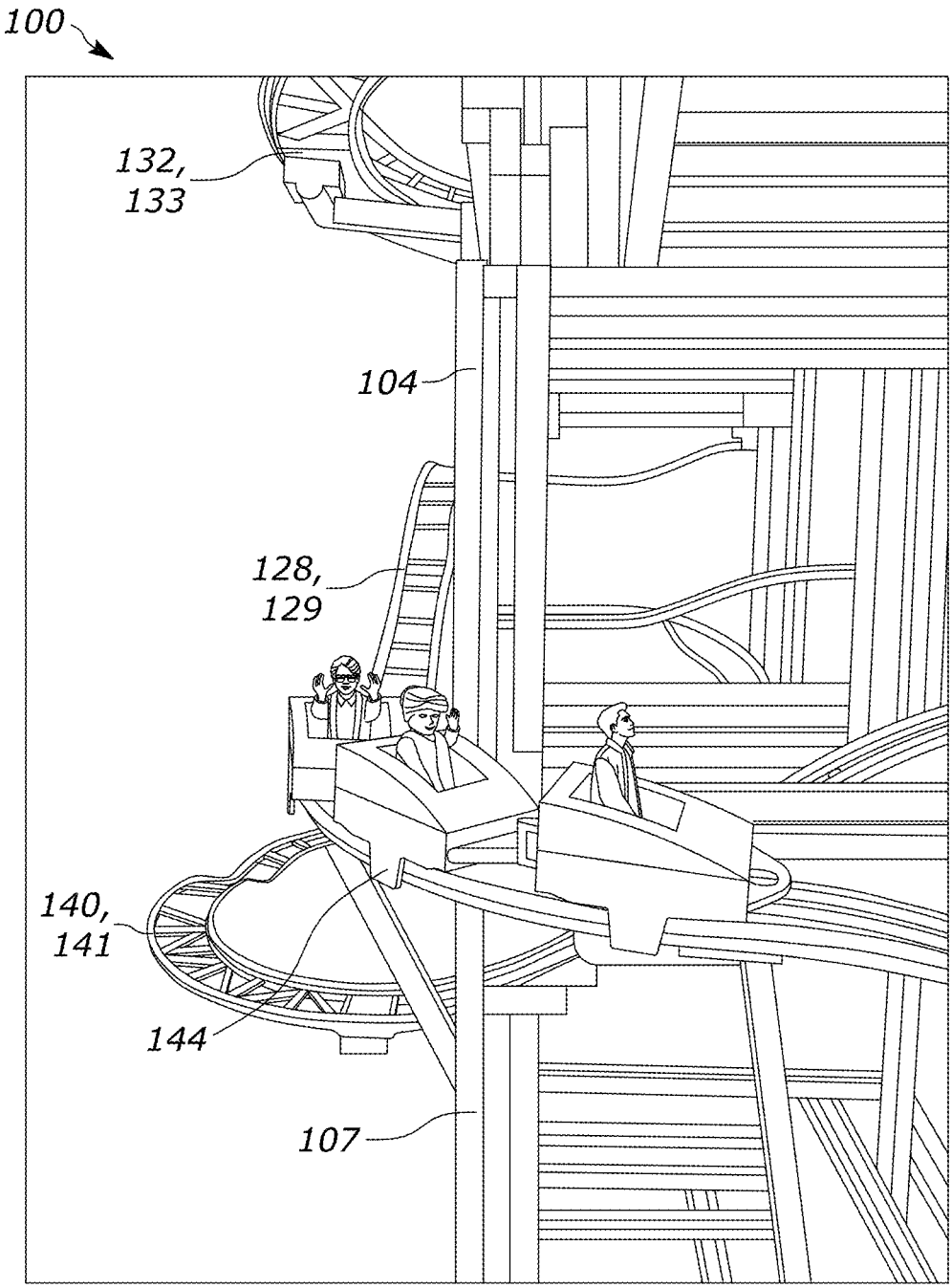
FIG. 27 is similar to FIG. 23 but shows the first train of coasters traversing another portion of the first track.

The first tower module 112 further includes one or more drive tires 119 configured for accelerating or decelerating each train of coasters 144, 152 as the trains travel along the first and third fourth tracks 128, 136, respectively. In the present example, as best shown by FIGS. 10 and 11, each of the tracks 128, 136 includes two drives tires 119, one of which is disposed adjacent the top end of the first tower module 112, and one of which is disposed adjacent the base 117 (and the bottom end of the first tower module 112). In other examples, each track 128, 136 may include only a single drive tire 119 adjacent the top end of the first tower module 112 or adjacent the base 117. In any event, in this example the drive tire 119 disposed adjacent the top end of the first tower module 112 is configured for accelerating the respective train of coasters along the respective track. In contrast, the drive tire 119 disposed adjacent the base 117 is configured for decelerating the respective train of coasters along the respective track.

Figure 6:
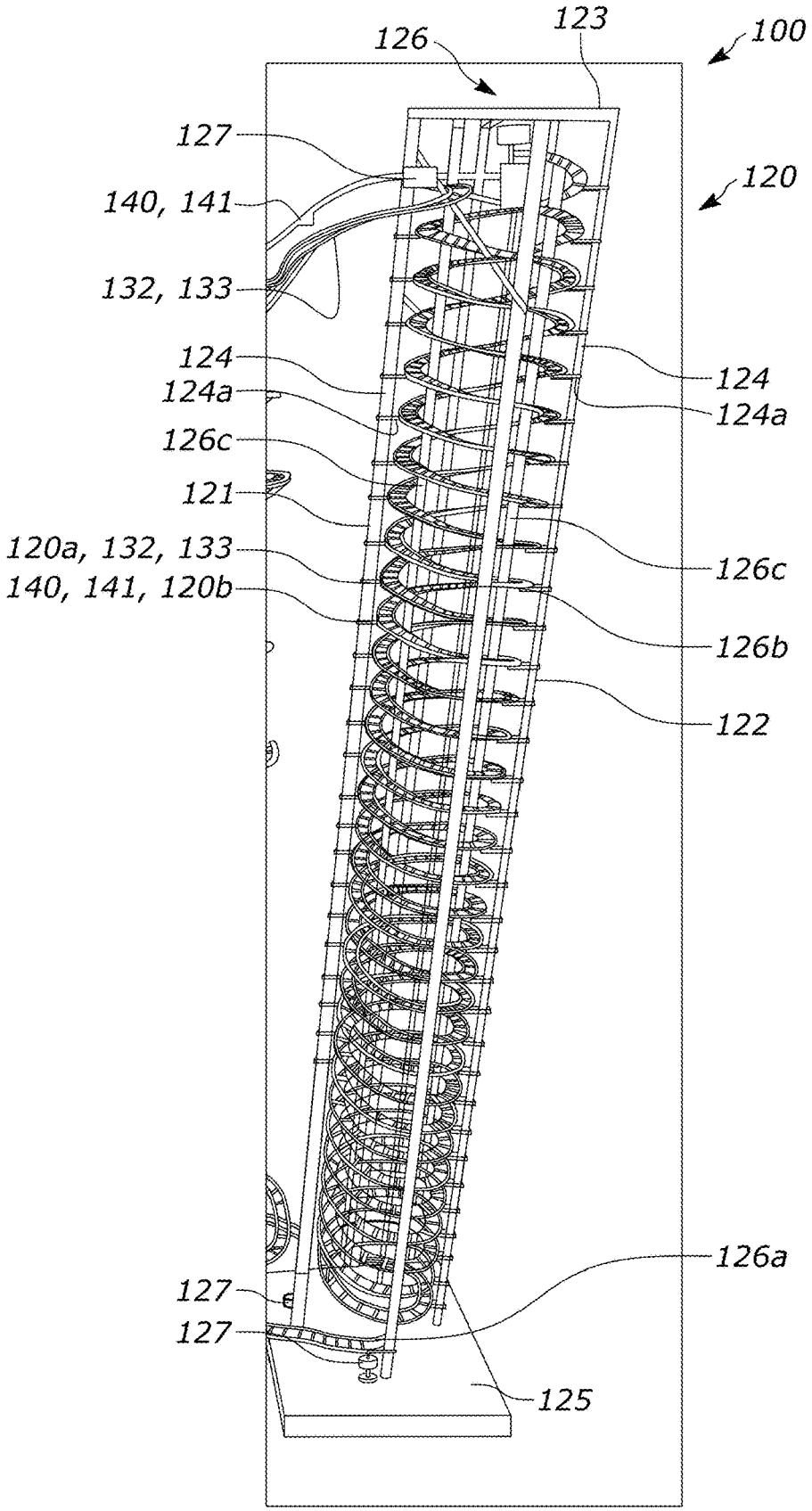
FIG. 6 is a front perspective view of a second tower module of the roller coaster of FIG. 1.

The second tower module 120, as shown in FIG. 6, is generally configured for supporting and retaining at least a portion of the second and fourth tracks 132, 140. In the present example, the second tower module 120 is substantially similar to the first tower module 112 in that the second tower module 120 includes or has a second inner edge 121, a second outer edge 122, a second tower module height 123, one or more connectable second tower sections 124, one or more support arms 124*a*, a base 125 (which, like the base 117, is optional), a second lift mechanism 126, and one or more drive tires 127 that are substantially similar to the first inner edge 113, the first outer edge 114, the first tower module height 115, the connectable first tower sections 116, the support arms 116*a*, the base 117, the lift mechanism 118, and the one or more drive tires 119, respectively. Moreover, like the first lift mechanism 118, the second lift mechanism 126 includes a motor 126*a*, a central rod 126*b*, and one or more carrier arms 126*c* that are substantially similar to the motor 118*a*, central rod 118*b*, and the carrier arms 118*c*, respectively. However, the second tower module 120 is different in a few respects. First, unlike the first tower module 112, the second tower module 120 retains at least a portion of the second and fourth tracks 132, 140. In particular, the support arms 124*a* extend into the second tower module 120 and support and retain the second and fourth tracks 132, 140 within the second tower module 120. Second, the second inner edge 121 is disposed adjacent the second side 106 of the central module 104 such that the center module 104 is disposed between the first tower module 112 and the second tower module 120.

In any event, it will be appreciated that the first tower module height 115 is substantially equal to the second tower module height 123. Therefore, the center module height 108 is less than the first tower module height 115 and the second tower module height 123. Moreover, the distance between the first outer edge 114 of the first tower module 112 and the second outer edge 122 of the second tower module 120 defines a roller coaster width 160. In the present example, the first tower module height 115 (and thus the second tower module height 123) is greater than the roller coaster width 160. In other examples, the roller coaster width 160 may be equal to the first tower module height 115 or greater than the first tower module height 115.

Each of the first, second, third, and fourth tracks 128, 132, 136, 140 is configured for movably supporting and retaining the first, second, third, and fourth train of coasters 144, 148, 152, 156, respectively, as the coasters 144, 148, 152, 156 traverse the tracks 128, 132, 136, 140, respectively. In the present example, the tracks and coasters use a rail and wheel system such that the running wheels of each of the trains of coasters 144, 148, 152, 156 sit on top of the tracks 128, 132, 136, 140, respectively, and support the weight of the coasters and the rider(s) in the coasters. In other examples, the tracks and coasters may use other rail and wheel systems (e.g., wheels underneath the rail or along the inner or outer side of the rail) or a different type of connection (e.g., magnetic levitation, air levitation, or a cable). In any event, it will be appreciated that the first, second, third, and fourth layouts 129, 133, 137, 141, defined by the first, second, third, and fourth tracks 128, 132, 136, 140 respectively, are mutually exclusive routes or paths along the roller coaster 100. Moreover, in the present example, at least a portion of the first and third layouts 129, 137 have a helical shape within at least a portion of the first tower module 112. More particularly, in this example, the portions of the first and third layouts 129, 137 spanning the first tower module 112 have a helical shape. Similarly, at least a portion of the second and fourth layouts 133, 141 have a helical shape within at least a portion of the second tower module 120. More particularly, in this example, the portions of the second and fourth layouts 133, 141 spanning the second tower module 120 have a helical shape. In other examples, portions of the first, second, third, and fourth layouts 129, 133, 137, 141 may have other shapes including, for example, a camelback shape, a spiral shape, a carousel turn, a corkscrew shape, or a cobra roll (i.e., two inversions back-to-back in a mirrored layout).

As best shown in FIGS. 14-18, the roller coaster 100 further includes a set of track elements 164 that generally define the "thrill" of each of the layouts 129, 133, 137, 141 (and, more generally, the different tracks 128, 132, 136, 140 of the roller coaster 100). The track elements 164 include, for example, turn radius, number of turns, track length, number of drops, drop height and gradient (e.g., 164*a*, 164*b*), number of inclines, incline height and gradient, banking angle, helix diameter and pitch, twist angle (otherwise known as the roll rate), segment curvature continuity (the "jerk" rate), the number and type of inversions (e.g., 164*c*), the number of near-misses (also known as close-calls) (e.g., 164*d*, 164*e*, 164*f*), near-miss distance, tunnel length and number, proximity to other cars, quick starts and stops, average speed, top speed, sound and vibration zones, track overlap or interweave, darkness or limited visibility zones, g-force zones, and dwell times at peaks or valley zones. It will be appreciated that other track elements may be included in the roller coaster 100, but in any event, generally speaking, the more track elements 164 that define the layout, the more thrilling the associated track will be.

The track elements of each of the layouts 129, 133, 137, 141 are generally obtained based at least in part on user-specified parameters including, for example, requests for specific track elements 164, technical requirements for the roller coaster 100, and preferred ride dynamics (also known as thrill parameters). It will be appreciated that the technical requirements include at least the minimum and/or maximum age of the riders, max height and weight of the riders, max speed of the roller coaster, max height of the roller coaster, max width of the roller coaster, duration of the ride on the roller coaster, the minimum turning radius allowed, the maximum gradient allowed (incline or drop), vibration limits, minimum braking distance, evacuation accessibility, train throughput and capacity, lift (also known as launch) system load capacity, maximum g-force in all directions, restraint system capability, minimum rider head clearance, noise restrictions, wind and seismic load ratings, weather operating limits, land availability, and building and engineering codes. Moreover, it will be appreciated that preferred ride dynamics, or generally those design aspects of the roller coaster that improve the ride experience, include at least turn radius, number of turns, average and top speed, number of drops and inclines, drop and incline height and gradient, frequency of quick stops and starts, the number of near-misses, near-miss distance, preferred g-forces, frequency and type of inversions, track banking, abruptness of transitions between track elements, darkness and visibility limits, track interference illusions, vehicle movement beyond the track, ride pacing (also called variation in intensity), sensation of vulnerability, sound and vibration, and height and exposure of the ride.

Although the first, second, third, and fourth layouts 129, 133, 137, 141 are all defined by track elements 164, the layouts 129, 133, 137, 141 differ in a few key respects. First, each layout spans different portions of the center module 104, the first tower module 112, and the second tower module 120. Indeed, the first layout 129 spans at least the first portion 112*a* of the first tower module 112 and at least the first portion 104*a* of the center module 104. Moreover, the first layout 129 does not span any portion of the second tower module 120. In the present example, the first layout 129 spans substantially all if not entirely all the center module 104 and the first tower module 112. The second layout 133 spans at least the first portion 120*a* (if not the entirety) of the second tower module 120 and at least the second portion 104*b* (if not substantially the entirety) of the center module 104. The second layout 133 does not span any portion of the first tower module 112, and in the present example, the second layout 133 spans substantially all if not entirely all of the center module 104 and the second tower module 120. The third layout 137 spans at least the second portion 112*b* (if not the entirety) of the first tower module 112 and at least the third portion 104*c* (if not substantially all) of the center module 104. The fourth layout 141 spans at least the second portion 120*b* (if not the entirety) of the second tower module 120 and at least the fourth portion 104*d* (if not substantially all) of the center module 104. Second, the layouts include different positions along the center module 104, the first tower module 112, and the second tower module 120. Indeed, the first layout 129 has or includes a starting position within the first tower module 112 (e.g., at or adjacent the top end of the first tower module 112), an intermediate position disposed within the center module 104, and an end position disposed within the first tower module 112 (e.g., at or adjacent the base 117). With respect to this aspect, the third layout 137 is substantially similar to the first layout 129. In contrast, the second layout 133 includes a starting position within the second tower module 120, an intermediate position within the center module 104, and an end position within the second tower module 120. However, with respect to this aspect, the fourth layout 141 is substantially similar to the second layout 133.

Third, the paths that each of the layouts 129, 133, 137, 141 take through the center module 104 are different. For example, the first layout 129 first exits the first tower module 112 adjacent the top end of the first tower module 112 and drops through the center module 104 into a connectable center module section 107*a*. The first layout 129 then drops farther into the connectable center module section 107*a* and into a connectable center module section 107*b* before exiting the connectable center module section 107*b* adjacent the second side 106 of the center module 104. Subsequently, the first layout 129, which is at this location disposed outside the center module 104, is coupled to an extendable arm 109*a* and an extendable arm 109*b* extending from the center module 104 towards the second tower module 120 and turns toward a connectable center module section 107*c*. The first layout 129 then weaves around the around of the outside of the connectable center module section 107*c* and along the back of the center module 104 (from the viewpoint of FIG. 1). Meanwhile, the second layout 133 exits the second tower module 120 adjacent the second tower module height 123 and drops through center module 104 in a substantially similar way to the first layout 129. Indeed, the second layout 133 drops into the connectable center module section 107*c* and then a connectable center module section 107*d* before exiting the center module 104 and connecting to extendable arms 109*c*, 109*d* adjacent the first side 105 of the center module 104. However, the second layout 133, now disposed adjacent the bottom, front side of the connectable center module section 107*a*, then banks and drops sharply down the front side of the center module 104 before weaving around the second side 106 of the center module 104 adjacent the second tower module 120. The third layout 137 exits the first tower module 112 at an angle substantially equal to 90 degrees counterclockwise from the exit of the first layout 129 (as viewed from above). The third layout 137 then drops slightly and makes a sharp U-turn to travel between the first side 105 of the center module 104 and the first inner edge 113 of the first tower module 112, passing just below the first layout 129. At this location, the third layout 137 is supported by extendable arms 109*e*, 109*f*, 109*g* extending from the first side 105 of the center module 104. The third layout 137 then turns towards the front side of the center module 104 at or near the center module height 108 and drops sharply along the front side 105 of center module 104 adjacent but exterior to the connectable center module sections 107*a*, 107*b* before weaving around the second side 106 of the center module 104 and into the center module 104 at a location below the connectable center module section 107*c*. Finally, the fourth layout 141 exits second tower module 120 at an angle substantially equal to 90 degrees clockwise from the exit of the second layout 133 (as viewed from above). Then, the fourth layout 141, in a substantially similar way to the third layout 137, drops slightly and makes a sharp U-turn to travel between the second side 106 of the center module 104 and the second inner edge 121 of the second tower module 120, passing just below the second layout 133. At this location, the fourth layout 141 is supported by extendable arms 109*h*, 109*i*, 109*j* extending from the second side 106 of the center module 104 towards the second tower module 120. The fourth layout 141 then drops significantly and travels along the back of the center module 104 past but exterior to the connectable center module sections 107*c*, 107*d* before turning and traveling below the extendable arms 109*c*, 109*d* supporting the second layout 133. The fourth layout 141 then makes another turn around the front of the center module 104 and passes immediately adjacent the banked turn and sharp drop of the second layout 129 before turning into the center module 104 below the connectable center module section 107*b*.

The first, second, third, and fourth train of coasters 144, 148, 152, 156 are generally configured to transport riders along the roller coaster 100. In the present example, each of the train of coasters 144, 148, 152, 156 includes one or three coasters. In other examples, each of the train of coasters 144, 148, 152, 156 may include two, four, five, or more coasters. Additionally, in the present example each of the first, second, third, and fourth tracks 128, 132, 136, 140 may simultaneously include a plurality of the first, second, third, and fourth train of coasters 144, 148, 152, 156, respectively. In other words, and for example, multiple first trains of coasters 144 can simultaneously traverse the first track 128, albeit at safe distances from one another. In other examples, it will be appreciated that there may be only one train of coasters or more trains of coasters on each of the tracks. In more examples, there may be a single train of coasters on one track but more than one train of coasters on other tracks.

Figure 29:
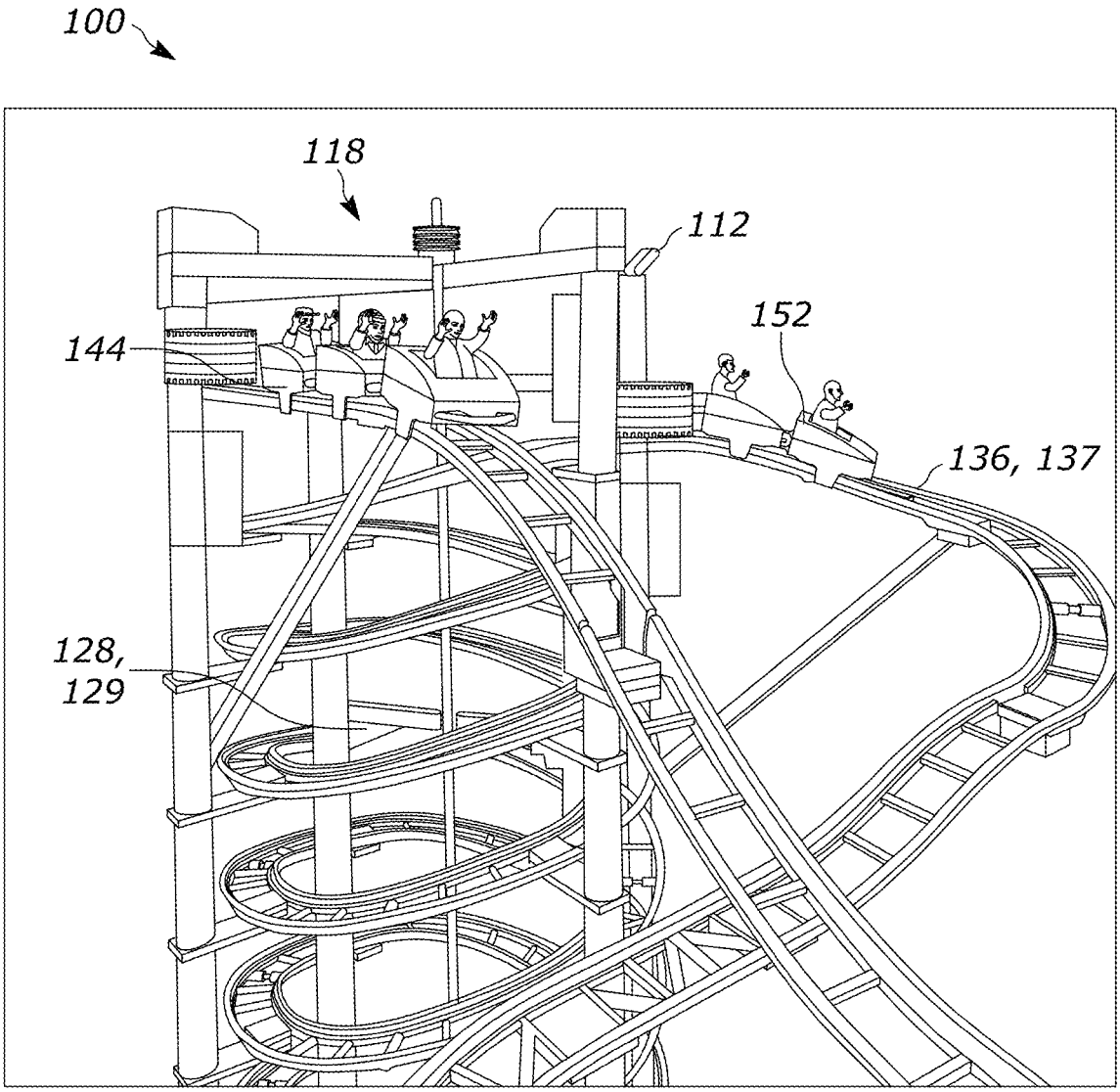
FIG. 29 is similar to FIG. 28 but shows the first train of coasters and the third train of coasters traversing different portions of the first track and the third track, respectively.
Figure 30:
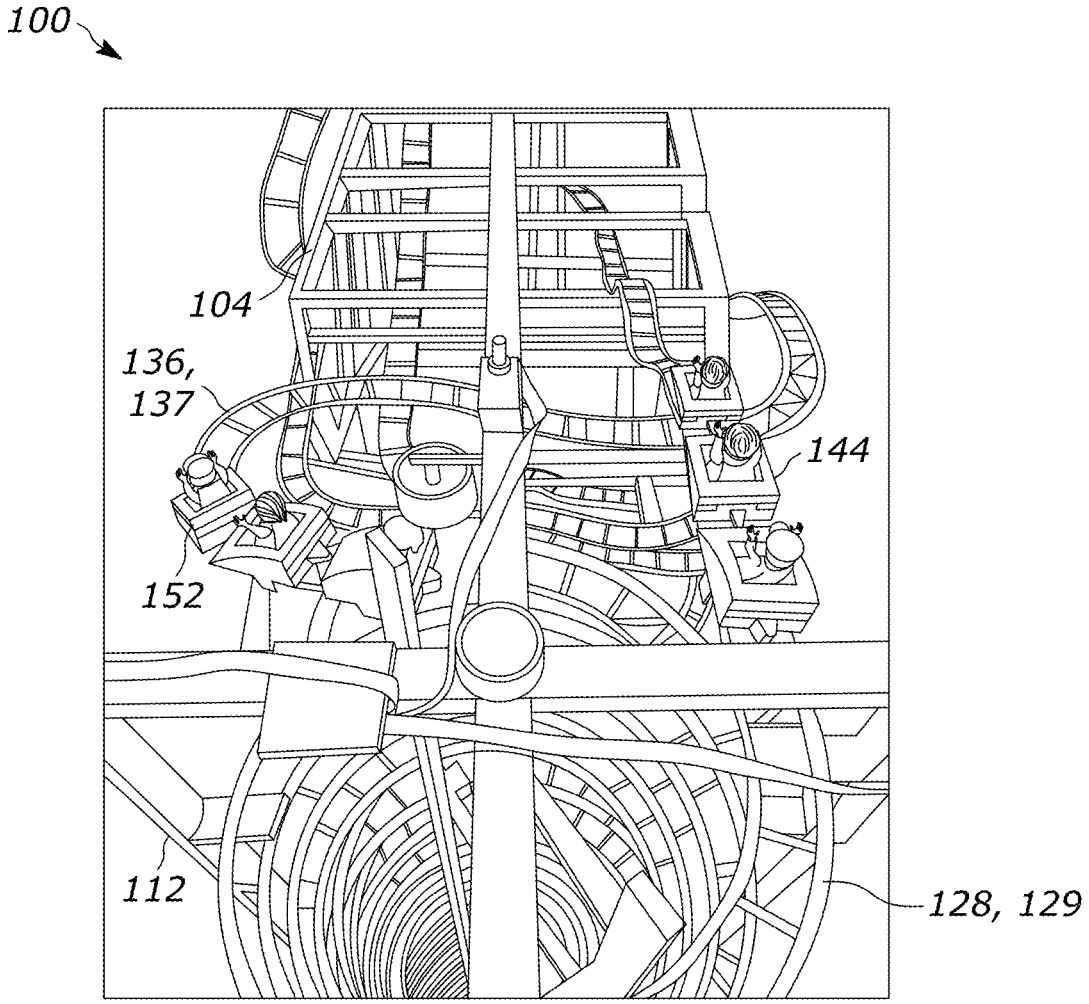
FIG. 30 is a top view of FIG. 29.

Further details regarding how the trains of coasters 144, 148, 152, 156 traverse the tracks 128, 132, 136, 140 will now be described. As shown by FIGS. 19-24, the trains of coasters 144, 148, 152, 156 include at least one coupling mechanism 168 extending away from at least one coaster of each train of coasters 144, 148, 152, 156. In the present example, only the first coaster in each train of coasters 144, 148, 152, 156 includes the coupling mechanism 168 such that this first coaster is slidably coupled to one of the carrier arms 118*c* of the lift mechanism 118. Moreover, the coupling mechanism 168, which in the present example extends away from the left side of the first coaster such that the coupling mechanism 168 extends inward into the first tower module 112 (or the second tower module 120), is a half-cylinder-shaped protrusion configured for at least partially engaging with one of the carrier arms 118*c* (or one of the carrier arms 126*c*). In other examples, the coupling mechanism 168 may use a different system (e.g., a pin-and-socket joint or a locking collar) or have a protrusion with a different shape (e.g., a square or rectangle). Additionally, in other examples, the coupling mechanism 168 may be disposed on more than one coaster of each of the trains of coasters 144, 148, 152, 156, and/or the coupling mechanism 168 may extend from another part of the coaster. In any event, the coupling mechanism 168 slidably couples to the carrier arm 118*c* of the first lift mechanism 118 (or the carrier arm 126*c* of the second lift mechanism 126) such that the rotation of the first lift mechanism 118 (or the second lift mechanism 126) causes, for example, the first train of coasters 144 to partially traverse the first layout 129. Similarly, the rotation of the first or second lift mechanism 118, 126 causes the second, third, and fourth train of coasters 148, 152, 156 to partially traverse the second, third, and fourth layouts 133, 137, 141, respectively. Said differently, the coupling of the coupling mechanism 168 to the first or second lift mechanism 118, 126 allows each of the train of coasters 144, 148, 152, 156 to move from one point along the layouts 129, 133, 137, 141, respectively, at a first time (e.g., FIG. 23) to another point along the layouts 129, 133, 137, 141 at a second time (e.g., FIG. 24) until the train of coasters has traversed the layouts 129, 133, 137, 141 to a point adjacent the top end of the first tower module 112 (or the top end of the second tower module 120), as shown in FIGS. 29 and 30. In particular, in the present example, the first train of coasters 144 and the third train of coasters 152 concurrently ascend the first tower module 112. Similarly, the second train of coasters 148 and the fourth train of coasters 156 concurrently ascend the second tower module 120. In other examples, however, the trains of coasters 144, 148, 152, 156 may ascend the first and second tower modules entirely independently of each other.

As discussed above, in the present example, the trains of coasters 144, 148, 152, 156 are configured to movably traverse the tracks 129, 133, 137, 141, respectively. In particular, in the present example, the first train of coasters 144 and the second train of coasters 148 are configured to concurrently traverse the first and second layouts 129, 133, respectively. Likewise, in the present example, the third train of coasters 152 and the fourth train of coasters 156 are configured to concurrently traverse the third and fourth layouts 137, 141, respectively. Further, at least in the present example, the first and third trains of coasters 144, 152 are configured to concurrently traverse the first and third layouts 129, 137, respectively, and the second and fourth trains of coasters 148, 156 are configured to concurrently traverse the second and fourth layouts 133, 141, respectively.

Figure 28:
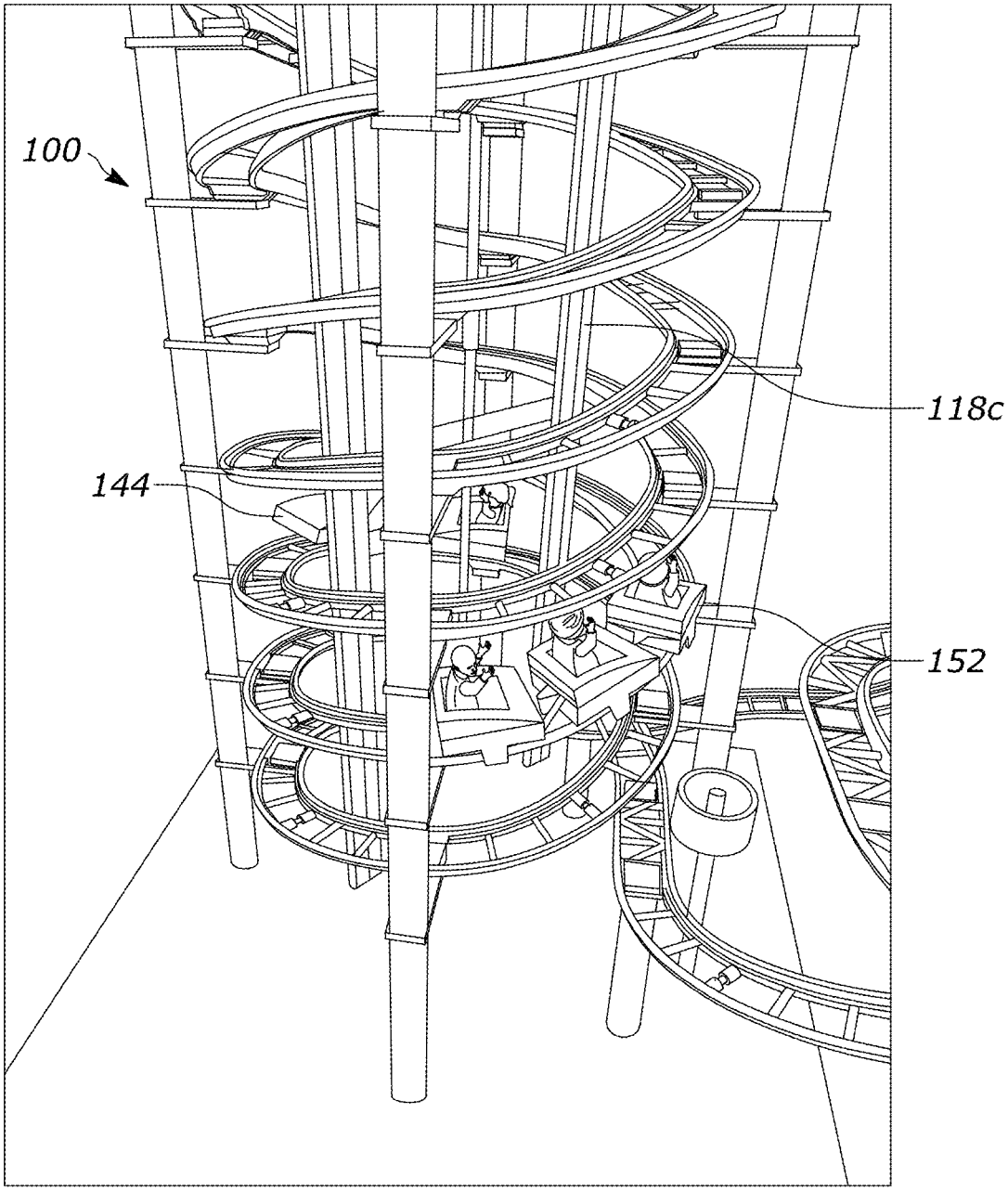
FIG. 28 is similar to FIG. 25 but shows the first train of coasters and the third train of coasters traversing different portions of the first track and the third track, respectively.
Figure 31:
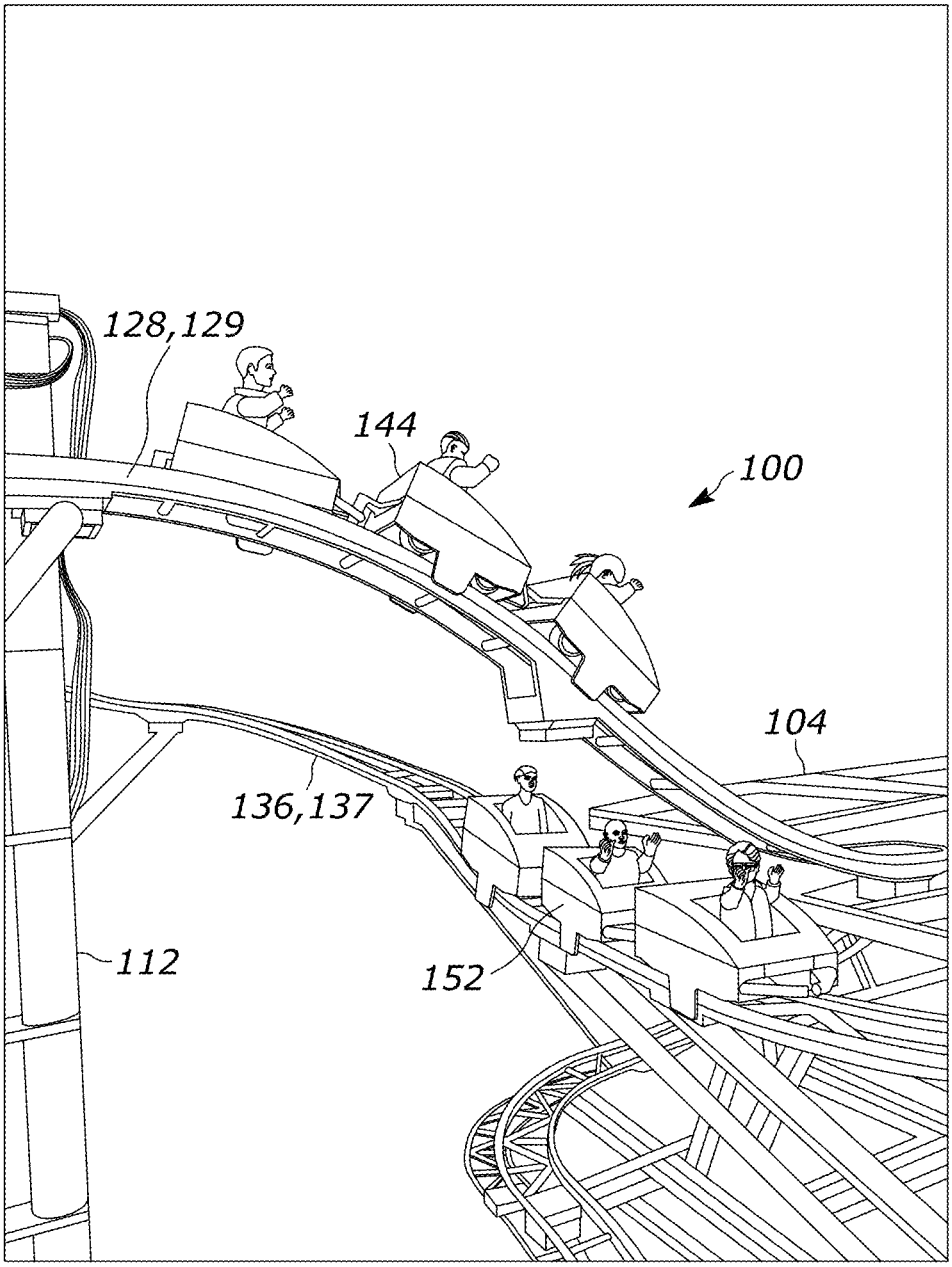
FIG. 31 is similar to FIG. 29 but shows the first train of coasters and the third train of coasters traversing different portions of the first track and the third track, respectively.
Figure 32:
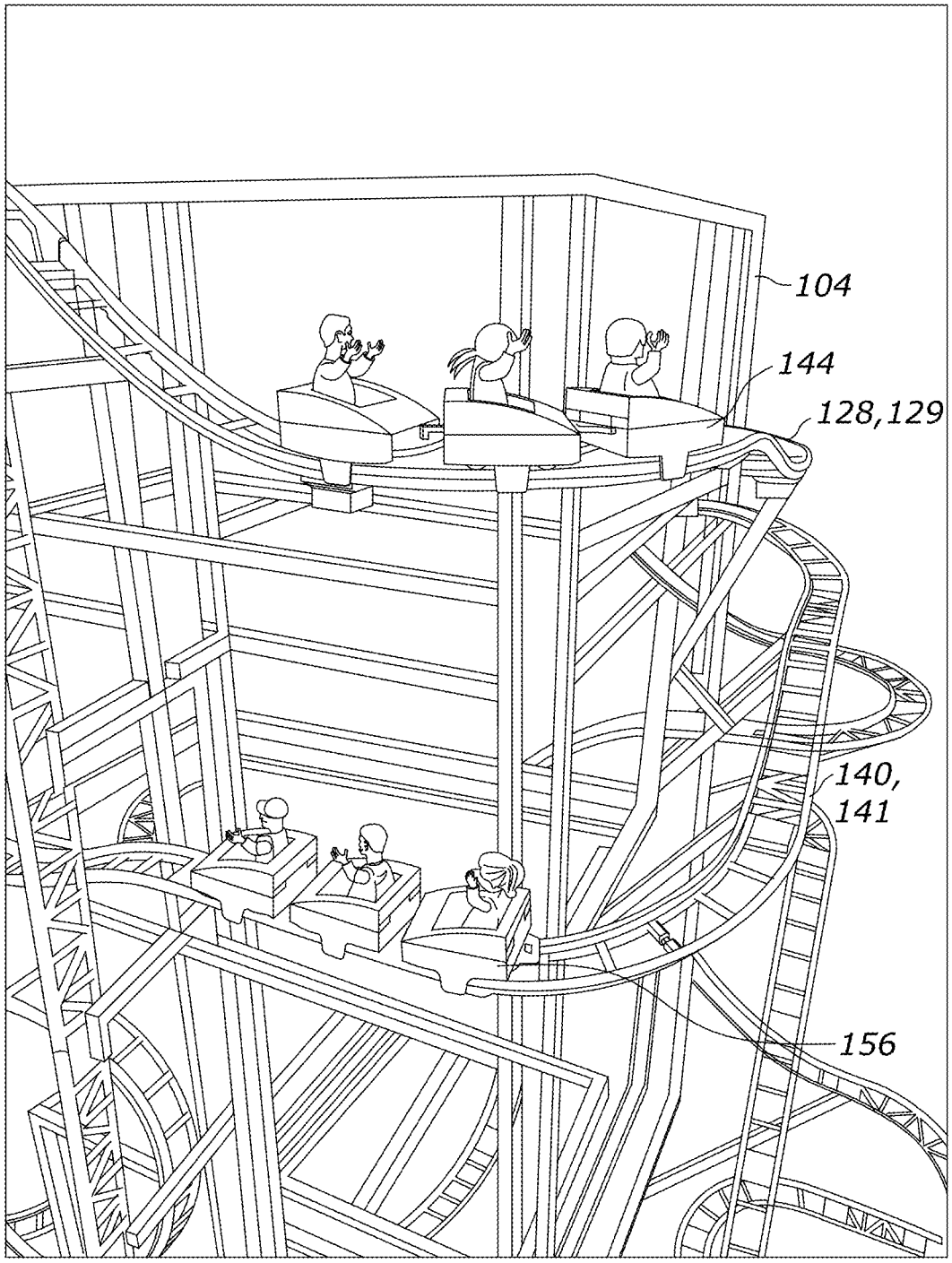
FIG. 32 is similar to FIG. 31 but shows the first train of coasters and the third train of coasters traversing different portions of the first track and the third track, respectively.

Specific reference will now be made to FIGS. 28-32 to discuss the movement of the coasters 144, 148, 152, 156 along the tracks 128, 132, 136, 140, respectively. In particular, FIG. 28 shows two of the coasters 144, 152 along the tracks 128, 136 (i.e., the first train of coasters 144 along the first track 128 and the third train of coasters 152 along the third track 136) at a first point in time when the coasters 144, 152 are adjacent the starting points of the first and third tracks 128, 136, respectively. Then, in FIGS. 29 and 30, at a second time after the first time, the coasters 144, 152 have moved along the tracks 128, 136 to a point adjacent the top end of the first tower module 112. At yet another later time (e.g., a third time) after the second time, as shown in FIG. 31, the first and third coasters 144, 152 have moved further along the first and third tracks 128, 136, respectively, such that the first train of coasters 144 is disposed immediately adjacent (in this case directly above) the third train of coasters 152 along a portion of the first layout 141. Then, at yet another point in time after the third time, FIG. 32 shows the first and third train of coasters 144, 156 further along the first and third tracks 128, 136, respectively. It will be appreciated that, although not shown in the figures, each of the trains of coasters 144, 148, 152, 156 will continue to move along the entire length of the tracks 128, 132, 136, 140, respectively, until the trains 144, 148, 152, 156 have entirely traversed the layouts 129, 133, 137, 141, respectively, and the rides are complete. It will also be appreciated that each of the train of coasters 144, 148, 152, 156 may be disposed immediately adjacent the other trains of coasters (e.g., the first train of coasters 144 and fourth train of coasters 156) at various points along the first, second, third, and fourth layouts 129, 133, 137, 141.

As used herein, the term "interacts" refers to situations in which two (or more) trains of coasters 144, 148, 152, 156, for example, race each other (for part or all of the ride), are disposed immediately adjacent each other (e.g., within 5-10 feet of each other), are parallel to (or aligned with) each other, or cross over or under each other, thereby creating the illusion for riders of the two (or more) trains of coasters 144, 148, 152, 156 of close calls or near misses (with one or more other trains) and that the two or more trains of coasters are dueling.) For example, the first train of coasters 144 interacts with the second train of coasters 148 as the first and second trains of coasters 144, 148 concurrently traverse the first and second layouts 129, 133, respectively, by virtue of the fact that the first train of coasters 144 is disposed immediately adjacent the second train of coasters 148 along at least a portion of the first layout 129 and the first train of coasters 144 races the second train of coasters 148 (also shown in FIG. 29) as the two trains 144, 148 traverse the layouts 129, 133, respectively. Likewise, the third train of coasters 152 interacts with the fourth train of coasters 156 as the third and fourth trains of coasters 152, 156 concurrently traverse the third and fourth layouts 137, 141, respectively, by virtue of the fact that the third train of coasters 152 is disposed immediately adjacent the fourth train of coasters 156 along at least a portion of the third layout 137 and the third train of coasters 152 races the fourth train of coasters 156 as the two trains 152, 156 traverse the layouts 137, 141, respectively. As another example, the third train of coasters 152 interacts with the first train of coasters 144 as the first and third trains of coasters 144, 152 concurrently, respectively, by virtue of the fact that the first and third trains race and the third track 136 crosses over the first track 128 (such that the first and third tracks 128, 136 appear to intersect), as shown in FIG. 29. In fact, in the present example, the first, second, third, and fourth trains of coasters 144, 148, 152, 156 can race one another as the trains of coasters traverse the layouts 129, 133, 137, 141, respectively. In other words, at least in the present example, the roller coaster 100 may be referred to as a quadruple dueling roller coaster.

As discussed above, the center module 104 includes the connectable center module sections 107, the first tower module 112 includes the connectable first tower sections 116, and the second tower module 120 includes the connectable second tower sections 124 configured adapted to be installed in an environment (e.g., in a theme park). It will be appreciated that the selection and/or assembly of the connectable center module sections 107, the connectable first tower sections 116, and the connectable second tower sections 124 can be based on any of the specified user parameters discussed above. For example, a person or entity that wants to build the roller coaster 100 can select the number, size, shape, or configuration of the connectable center module sections 107, the connectable first tower sections 116, or the connectable second tower sections 124 and can assemble these sections 107, 116, and/or 124 to satisfy or achieve various technical requirements (e.g., max height of the roller coaster 100) and/or preferred ride dynamics (e.g., the requested number of turns). Moreover, the first track 128 is defined by a plurality of connectable first track sections 130, the second track 132 is defined by a plurality of connectable second track sections 134, the third track 136 is defined by a plurality of connectable third track sections 138, and the fourth track 140 is defined by a plurality of connectable fourth track sections 142. Likewise, it will be appreciated that the selection and/or assembly of the track sections 130, 134, 138, and 142 can be based on any of the specified user parameters discussed above. For example, the tracks 128, 132, 136, 140 may be composed of any number of the sections 130, 134, 138, 142 (e.g., 3, 5, 10, or 20) based on the specified user parameters (e.g., to achieve the desired track length). Accordingly, the roller coaster 100 is modular, which offers several benefits. First, the connectable sections 107, 116, 124, 130, 134, 138, 142 can be partially or fully assembled and installed on site in the environment. Second, the center module 104, first tower module 112, second tower module 120, and the tracks 128, 132, 136, 140 may be assembled in the environment for only a limited amount of time and then taken down. Third, the roller coaster 100 may then be moved to a different environment and assembled in the same configuration, or on-site changes may be made to roller coaster 100 based on the specified user parameters.

Figure 33:
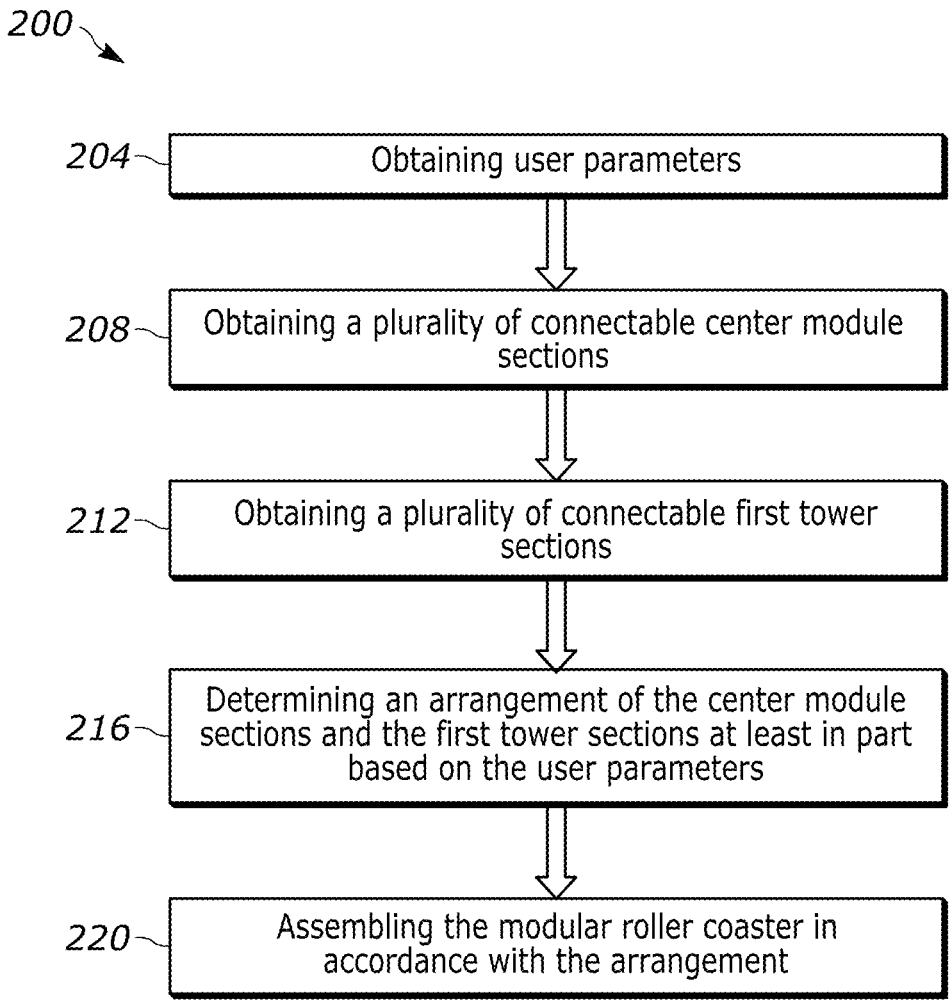
FIG. 33 is one example of a method of assembling and installing a modular roller coaster in an environment in accordance with the present disclosure.

FIG. 33 depicts an example of a method or process 200 for assembling and installing a modular roller coaster such as the roller coaster 100 in the environment. The method or process 200 is performed in the order shown and described herein, but may be implemented in or according to any number of different orders. The method or process 200 may, in other examples, include additional, fewer, or different acts.

The method 200 first includes the act 204 of obtaining user parameters for the modular roller coaster 100. The user parameters include the same user parameters described herein for the roller coaster 100, but it will be appreciated that other user parameters may be obtained as part of the method 200.

The method 200 then includes the act 208 of obtaining a plurality of connectable center module sections (e.g., the connectable center module sections 107). In the present example, the act 208 includes obtaining 40 connectable center module sections, but in other examples the act 208 may include obtaining more or less connectable center module sections (e.g., 20, 30, or 50).

The method 200 then includes the act 212 of obtaining a plurality of connectable first tower sections (e.g., the connectable first tower module sections 115). In the present example, the act 212 includes obtaining 34 connectable first tower sections configured for vertical arrangement (e.g., for vertical stacking), but in other examples the act 212 may include obtaining more or less connectable first tower module sections (e.g., 20, 30, or 50). The method 200 then includes the act 214 of obtaining a plurality of first track sections (e.g., track sections 130) and a plurality of second track sections (e.g., track sections 138).

The method 200 then includes the act 216 of determining an arrangement of the center module sections, the first tower sections, the first track sections, and the second track sections at least in part based on the user parameters. In the present example, it will be appreciated that the determination may be based on any number of user parameters (e.g., 2, 5, or 10). In any event, the arrangement of the center module sections, the first tower sections, the first track sections, and the second track sections generally define the track elements (e.g., the track elements 164) of the modular roller coaster 100.

The method 200 then includes the act 220 of assembling the modular roller coaster 100 to produce or achieve the determined arrangement. The act 220 includes connecting the plurality of connectable center module sections to form a center module (e.g., the center module 104), connecting the plurality of connectable first tower sections to form a first tower module (e.g., the first tower module 112), connecting the first track sections to form a first track (e.g., the first track 128) defining a first layout (e.g., the layout 129), the first layout spanning at least a first portion (e.g., the first portion 104*a*) of the center module and a first portion (e.g., the first portion 112*a*) of the first tower module, and connecting the second track sections to form a second track (e.g., the second track 132) defining a second layout (e.g., the second layout 133), the second layout spanning at least a second portion (e.g., the second portion 104*b*) of the center module and a second portion (e.g., the second portion 112*b*) of the first tower module.

Figure 34:
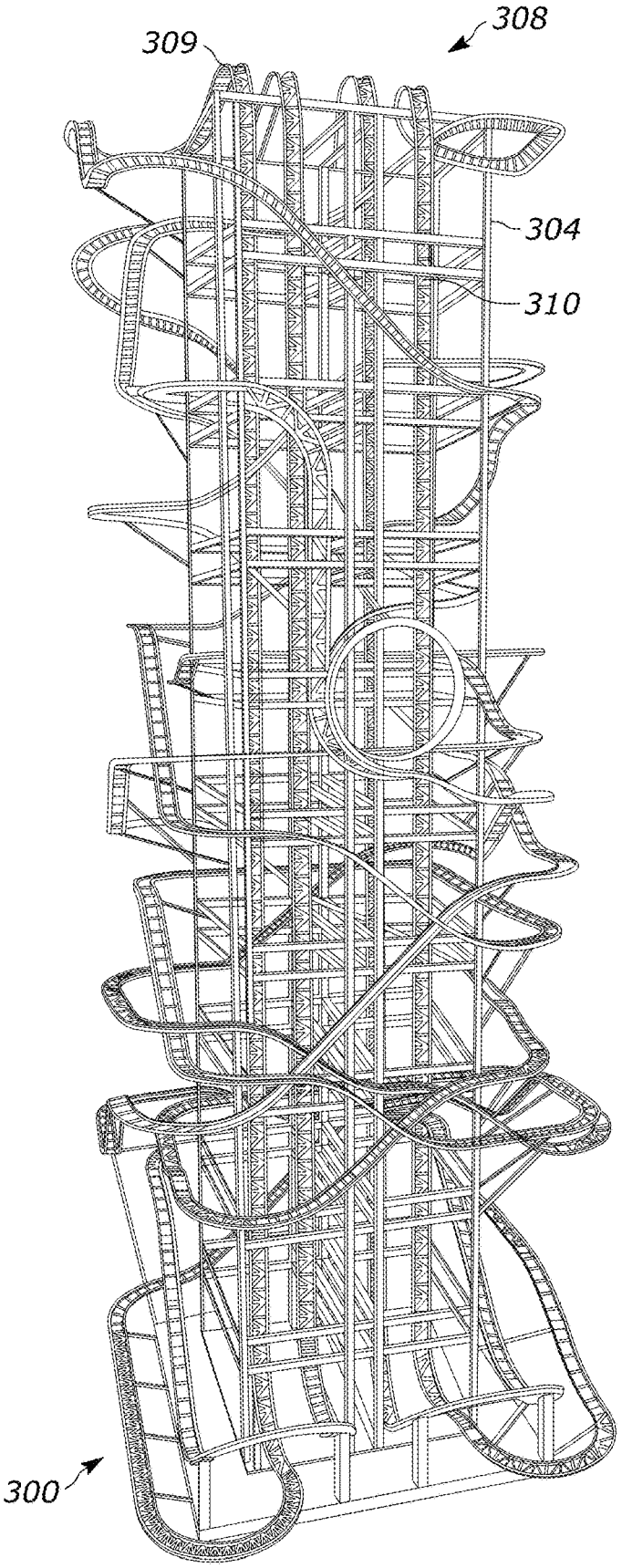
FIG. 34 is a front perspective view of another example of a roller coaster constructed in accordance with the present disclosure.

FIG. 34 shows another example of a roller coaster 300 that is constructed in accordance with the teachings of the present disclosure. The roller coaster 300 is substantially similar to the roller coaster 100 but differs in a few key respects. First, in the present example, the roller coaster 300 includes the center module 304 (which is substantially similar to the center module 104) but does not include the first tower module 112 or the second tower module 120. Second, the roller coaster 300 includes a lift mechanism 308 that differs from the lift mechanisms 118, 126 of the roller coaster 100. In particular, unlike the lift mechanisms 118, 126, the lift mechanism 308 is a vertical chain lift system that includes at least one motor 309 and at least one chain 310 for each of the tracks 128, 132, 136, 140. In particular, the lift mechanism 308 works such that the each of the trains of coasters 144, 148, 152, 156 is pulled up through the inside of the center module 304 to the top of the center module 304 along the tracks 128, 132, 136, 140, respectively. In other examples, there may only be one motor 309 for all of the chains 310. Moreover, there may be more than one chain 310 (e.g., 2, 3, or 5 chains) for each of the tracks 128, 132, 136, 140. Additionally, in the present example the motor 309 is disposed adjacent the top of the center module 104, but in other examples the motor 308 may be disposed near the base of the center module 104. Finally, the configuration of the tracks elements 164 is different for the roller coaster 300 as compared to the roller coaster 100, as will be appreciated by a side-by-side comparison of the roller coaster 100 and the roller coaster 300. However, it will be appreciated that like the roller coaster 100, the track elements 164 for the roller coaster 300, can be selected and/or assembled based at least in part on the user parameters described herein.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Numerous alternative examples could be implemented, using either current technology or technology developed after the filing date of this patent, which would still fall within the scope of the claims. Additionally, the described embodiments/examples/implementations should not be interpreted as mutually exclusive and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as critical, required, or essential features or elements of any or all the claims. The claimed invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting example the term is defined to be within 10%, in another example within 5%, in another example within 1% and in another example within 0.5%. The term "coupled" as used herein is defined as connected, although not necessarily directly and not necessarily mechanically. A device or structure that is "configured" in a certain way is configured in at least that way, but may also be configured in ways that are not listed.

Further, unless expressly stated to the contrary, "or" refers to an inclusive or and not to an exclusive or. For example, "A, B or C" refers to any combination or subset of A, B, C such as (1) A alone, (2) B alone, (3) C alone, (4) A with B, (5) A with C, (6) B with C, and (7) A with B and with C. As used herein, the phrase "at least one of A and B" is intended to refer to any combination or subset of A and B such as (1) at least one A, (2) at least one B, and (3) at least one A and at least one B. Similarly, the phrase "at least one of A or B" is intended to refer to any combination or subset of A and B such as (1) at least one A, (2) at least one B, and (3) at least one A and at least one B.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, inventive subject matter may lie in less than all features of a single disclosed example. Thus, the following claims are hereby incorporated into the Detailed Description, with each claim standing on its own as a separately claimed subject matter.

Finally, any references, including, but not limited to, publications, patent applications, and patents cited herein are hereby incorporated in their entirety by reference to the same extent as if each reference were individually and specifically indicated to be incorporated by reference and were set forth in its entirety herein.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The invention claimed is:

1. A roller coaster, comprising:

a center module having a first side and a second side opposite the first side;

a first tower module disposed adjacent the first side of the center module;

a second tower module disposed adjacent the second side of the center module;

a first track defining a first layout spanning at least a first portion of the first tower module and at least a first portion of the center module;

a second track defining a second layout spanning at least a first portion of the second tower module and at least a second portion of the center module;

a first train of coasters configured to movably traverse the first track; and a second train of coasters configured to movably traverse the second track, wherein the first train of coasters and the second train of coasters are configured to concurrently traverse the first and second layouts, respectively, and wherein the first train of coasters interacts with the second train of coasters along at least a portion of the first layout.

2. The roller coaster of claim 1, wherein the first tower module has a first tower height and the second tower module height has a second tower height that is substantially equal to the first tower height.

3. The roller coaster of claim 2, wherein the center module has a center module height less than the first tower height and the second tower height.

4. The roller coaster of claim 2, wherein the first tower module further comprises a first outer edge and the second tower module further comprises a second outer edge, wherein the distance between the first outer edge and the second outer edge defines a roller coaster width, and wherein the first tower module height is greater than the roller coaster width.

5. The roller coaster of claim 1, wherein the first layout does not span any portion of the second tower module.

6. The roller coaster of claim 1, wherein each of the first and second tower modules is a spiral lift tower.

7. The roller coaster of claim 1, further comprising a third track defining a third layout spanning at least a second portion of the first tower module and at least a third portion of the center module, and a fourth track defining a fourth layout spanning at least a second portion of the second tower module and at least a fourth portion of the center module.

8. The roller coaster of claim 7, further comprising a third train of coasters and a fourth train of coasters, wherein the third and fourth trains of coasters are configured to concurrently traverse the third and fourth layouts, respectively.

9. The roller coaster of claim 7, wherein at least a portion of the first layout and at least a portion of the third layout have a helical shape.

10. The roller coaster of claim 7, wherein at least a portion of the second layout and at least a portion of the fourth layout have a helical shape.

11. The roller coaster of claim 1, wherein the first train of coasters is disposed immediately adjacent the second train of coasters along at least the portion of the first layout.

12. The roller coaster of claim 1, wherein the first layout comprises a starting position disposed within the first tower module, an intermediate position disposed within the center module, and an end position disposed within the first tower module.

13. A roller coaster, comprising:

a first tower module;

a second tower module;

a first track defining a first layout spanning at least a portion of the first tower module;

a second track defining a second layout spanning at least a portion of the second tower module; and a center module disposed between the first tower module and the second tower module, wherein the first layout is at least partially disposed within the center module, and wherein the second layout is at least partially disposed within the center module, wherein at least a portion of the first layout and at least a portion of the second layout have a helical shape.

14. The roller coaster of claim 13, further comprising:

a first spiral lift mechanism coupled to the first tower module; and a first train of coasters slidably coupled to the first spiral lift mechanism, wherein rotation of the first spiral lift mechanism causes the first train of coasters to partially traverse the first layout.

15. The roller coaster of claim 14, further comprising:

a second spiral lift mechanism coupled to the second tower module; and a second train of coasters slidably coupled to the second spiral lift mechanism, wherein rotation of the second spiral lift mechanism causes the second train of coasters to partially traverse the second layout.

16. The roller coaster of claim 13, wherein the center module has a center module height and the first tower module has a first tower module height, and wherein the first tower module height is greater than the center module height.

17. The roller coaster of claim 13, wherein the first layout does not span any portion of the second tower module.

18. The roller coaster of claim 13, further comprising a first train of coasters configured to movably traverse the first track and a second train of coasters configured to movably traverse the second track, wherein the first train of coasters interacts with the second train of coasters along at least a portion of the first layout.

19. The roller coaster of claim 13, wherein each of the first and second tower modules is a spiral lift tower.

20. A roller coaster, comprising:

a first tower module;

a second tower module;

a first track defining a first layout spanning at least a portion of the first tower module;

a second track defining a second layout spanning at least a portion of the second tower module; and a first train of coasters configured to movably traverse the first track and a second train of coasters configured to movably traverse the second track, wherein the first train of coasters interacts with the second train of coasters along at least a portion of the first layout, wherein at least a portion of the first layout and at least a portion of the second layout have a helical shape.

21. The roller coaster of claim 20, further comprising:

a first spiral lift mechanism coupled to the first tower module; and a first train of coasters slidably coupled to the first spiral lift mechanism, wherein rotation of the first spiral lift mechanism causes the first train of coasters to partially traverse the first layout.

22. The roller coaster of claim 21, further comprising:

a second spiral lift mechanism coupled to the second tower module; and a second train of coasters slidably coupled to the second spiral lift mechanism, wherein rotation of the second spiral lift mechanism causes the second train of coasters to partially traverse the second layout.

23. The roller coaster of claim 20, further comprising a center module disposed between the first tower module and the second tower module, wherein the first layout is at least partially disposed within the center module, and wherein the second layout is at least partially disposed within the center module, and wherein the center module has a center module height and the first tower module has a first tower module height, and wherein the first tower module height is greater than the center module height.

24. The roller coaster of claim 20, wherein the first layout does not span any portion of the second tower module.

* * * * *